US008391747B2

(12) United States Patent
Kim et al.

(10) Patent No.: US 8,391,747 B2
(45) Date of Patent: Mar. 5, 2013

(54) PROCESS CARTRIDGE AND IMAGE FORMING APPARATUS HAVING THE SAME

(75) Inventors: Jong-in Kim, Suwon-si (KR); Gun-soo Chang, Suwon-si (KR); Byeong-no Jeong, Suwon-si (KR); Yong-hun Kim, Suwon-si (KR); Dong-uk Kim, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 375 days.

(21) Appl. No.: 12/728,426

(22) Filed: Mar. 22, 2010

(65) Prior Publication Data

US 2011/0026967 A1 Feb. 3, 2011

(30) Foreign Application Priority Data

Jul. 30, 2009 (KR) ..... 10-2009-070004

(51) Int. Cl.
*G03G 21/16* (2006.01)
*G03G 21/18* (2006.01)

(52) U.S. Cl. ..... 399/111; 399/113

(58) Field of Classification Search ..... 399/110, 399/111, 113
See application file for complete search history.

(56) References Cited

U.S. PATENT DOCUMENTS

| | | | | |
|---|---|---|---|---|
| 7,054,578 | B2 | 5/2006 | Jung et al. | |
| 7,542,701 | B2 | 6/2009 | Kweon | |
| 7,567,769 | B2 * | 7/2009 | Noguchi et al. | 399/110 |
| 2005/0002687 | A1 | 1/2005 | Jung et al. | |
| 2006/0239711 | A1 | 10/2006 | Hymas et al. | |
| 2007/0053717 | A1 | 3/2007 | Kweon | |
| 2007/0053718 | A1 * | 3/2007 | Choi | 399/159 |
| 2008/0138109 | A1 * | 6/2008 | Anan et al. | 399/113 |
| 2008/0240773 | A1 * | 10/2008 | Sato et al. | 399/106 |

FOREIGN PATENT DOCUMENTS

| | | |
|---|---|---|
| EP | 2261756 | 12/2010 |
| JP | 5232789 | 9/1993 |
| KR | 10-0544191 | 1/2006 |
| KR | 100693338 | 3/2007 |

OTHER PUBLICATIONS

European Search Report issued Apr. 27, 2011 in EP Application No. 10157677.5.

Korean Office Action issued Dec. 20, 2010 in KR Application No. 10-2009-0070004.

* cited by examiner

*Primary Examiner* — Sandra Brase
(74) *Attorney, Agent, or Firm* — Stanzione & Kim, LLP

(57) ABSTRACT

A process cartridge usable with an image forming apparatus includes a developing member, a photosensitive medium to face the developing member, a pair of supporting plates to rotatably support the developing member and the photosensitive medium; a center moving member rotatably disposed on the supporting plate, the center moving member having a first position in which the photosensitive medium contacts the developing member and a second position in which the photosensitive medium is spaced apart from the developing member; and a separation restraining member formed so that when the center moving member locates at the second position, the separation restraining member restrains the center moving member from moving from the second position.

27 Claims, 21 Drawing Sheets

PROCESS CARTRIDGE AND IMAGE FORMING APPARATUS HAVING THE SAME

CROSS-REFERENCE TO RELATED APPLICATIONS

This application claims priority under 35 U.S.C. §119(a) from Korean Patent Application No. 2009-070004, filed Jul. 30, 2009 in the Korean Intellectual Property Office, the disclosure of which is incorporated herein in its entirety by reference.

BACKGROUND

1. Field of the Invention

The present general inventive concept relates to an electro photographic image forming apparatus. More particularly, the present general inventive concept relates to a detachable process cartridge usable with an electro photographic image forming apparatus and an image forming apparatus having the same.

2. Description of the Related Art

Generally, electro photographic image forming apparatuses, such as laser printers, copy machines, facsimile machines, or like, may use a process cartridge. The process cartridge may be formed so that a photosensitive medium on which an electrostatic latent image corresponding to printing data is formed, a developing member for supplying developer to the photosensitive medium to develop the electrostatic latent image into a visible image, and a developer storing chamber in which a predetermined amount of developer is received are formed as a single unit, and the single unit is formed as a cartridge type that may be removably installed in a main body of the image forming apparatus.

After the developer received in the developer storing chamber is completely consumed, the process cartridge is separated from the image forming apparatus, and a new process cartridge is installed in the image forming apparatus. In the process cartridge using a contact type developing method, the developing member may contact the photosensitive medium to form a developing nip (D in FIG. 2). In order to print a printed image having good quality by using the contact type developing method, the process cartridge is required to maintain a predetermined developing nip between the developing member and the photosensitive medium. Therefore, the process cartridge is sold in a state in which the developing member is uniformly spaced apart from the photosensitive medium.

Generally, the process cartridge may be provided to users in two states. First, when the image forming apparatus is sold, the process cartridge may also be sold in a state to be installed in the main body of the image forming apparatus. Second, the process cartridge may be sold independently of the image forming apparatus.

SUMMARY OF THE INVENTION

The present general inventive concept provides a process cartridge capable of preventing a photosensitive medium and a developing member from contacting with each other by vibration or shock applied to an image forming apparatus from the outside thereof during distribution thereof when the process cartridge is mounted in a main body of the image forming apparatus in the state that the photosensitive medium and the developing member are spaced apart from each other and is distributed in the state thereof, and an image forming apparatus having the same.

Additional aspects and/or utilities of the present general inventive concept will be set forth in part in the description which follows and, in part, will be obvious from the description, or may be learned by practice of the general inventive concept.

Furthermore, the present general inventive concept provides a process cartridge capable of preventing a photosensitive medium and a developing member from contacting with each other by vibration or shock applied from an external source during distribution thereof when the process cartridge is independently distributed in a state in which the photosensitive medium and the developing member are spaced apart from each other, and provides an image forming apparatus having the same.

Additional features and/or utilities of the present general inventive concept will be set forth in part in the description which follows and, in part, will be obvious from the description, or may be learned by practice of the general inventive concept.

Exemplary embodiments of the present general inventive provide a process cartridge usable with an image forming apparatus, which includes a developing member, a photosensitive medium to face the developing member, a pair of supporting plates to rotatably support the developing member and the photosensitive medium, a center moving member rotatably disposed on the supporting plate, the center moving member having a first position in which the photosensitive medium contacts the developing member and a second position in which the photosensitive medium is spaced apart from the developing member, and a separation restraining member formed so that when the center moving member locates at the second position, the separation restraining member restrains the center moving member from moving from the second position.

The separation restraining member may include a rotation limiting portion disposed on the supporting plate to limit a rotation range of the center moving member and a restraining protrusion formed on the supporting plate to restrain the center moving member from moving between the first position and the second position.

The rotation limiting portion may include a guiding groove formed on the supporting plate to guide a rotation of the center moving member. The center moving member may include an outer circumferential portion that is rotatably disposed in a supporting hole of the supporting plate and is formed in a cylindrical shape, an inner circumferential portion formed inside the outer circumferential portion, a center of the inner circumferential portion being eccentric to a center of the outer circumferential portion, the inner circumferential portion in which a center shaft of the photosensitive medium is connected, a lever which extends outwardly from the outer circumferential portion, and a guiding projection formed on the lever to insert in and to move along the guiding groove.

A first end of the guiding groove may correspond to the first position of the center moving member, and a second end of the guiding groove may correspond to the second position of the center moving member.

The restraining protrusion may include a contact restraining protrusion to restrain the lever of the center moving member from moving from the second position to the first position.

The contact restraining protrusion may be formed inside the guiding groove to interfere with the guiding projection of the lever of the center moving member.

The restraining protrusion may include a separation restraining protrusion to restrain the center moving member from moving from the first position when the center moving member locates at the first position.

The separation restraining protrusion may be formed on the supporting plate outside the guiding groove to interfere with a side surface of the lever of the center moving member.

The separation restraining protrusion may be formed in a triangular section, a first surface of the separation restraining protrusion to face the first end of the guiding groove may be formed substantially vertical to prevent the lever from moving toward the second end of the guiding groove, and a second surface of the separation restraining protrusion to face the second end of the guiding groove may be formed as an inclined surface so that the lever may move toward the first end of the guiding groove.

The center moving member may include an escape preventing protrusion that is formed on an end portion of the outer circumferential portion near inner surface of the supporting plate and prevents the center moving member from falling out of the supporting hole of the supporting plate.

The escape preventing protrusion may include two escape preventing protrusions formed at an angular interval of 180 degrees and two inserting grooves into which the two escape preventing protrusions are inserted may be formed on the supporting hole.

The escape preventing protrusions and the inserting grooves may have a positional relationship in that when the center moving member locates beyond the guiding groove, the escape preventing protrusions are inserted into the inserting grooves so that the center moving member connects with the supporting plate.

The supporting plate may include a guiding seat formed on the inner surface of the supporting plate at the outer circumference of the supporting hole to guide a movement of the escape preventing protrusion and a stopper formed at the guiding seat to limit a rotation of the escape preventing protrusion so that the center moving member moves between the first position and the second position.

The center moving member may include an insert limiting protrusion that is formed on an end portion of the outer circumferential portion near an outer surface of the supporting plate and limits a depth of the center moving member inserted into the supporting hole of the supporting plate.

Exemplary embodiments of the present general inventive concept also provide a process cartridge usable with an image forming apparatus, which may include a developing member, a photosensitive medium to face the developing member, a pair of supporting plates to rotatably support the developing member and the photosensitive medium, a center moving member rotatably disposed on the supporting plate, the center moving member to cause the photosensitive medium to locate either at a first position in which the photosensitive medium contacts the developing member or at a second position in which the photosensitive medium is spaced apart from the developing member, and a separation restraining member formed so that when the center moving member locates at the second position, the separation restraining member restrains the center moving member from moving from the second position, wherein when the process cartridge is separated from the image forming apparatus, the center moving member is moved over the separation restraining member and to the first position by a position changing member of the image forming apparatus.

Exemplary embodiments of the present general inventive also provide a process cartridge usable with an image forming apparatus, which may include a developing member; a photosensitive medium to face the developing member, a pair of supporting plates to rotatably support the developing member and the photosensitive medium, a center moving member rotatably disposed on the supporting plate, the center moving member to cause the photosensitive medium to locate either at a first position in which the photosensitive medium contacts the developing member or at a second position in which the photosensitive medium is spaced apart from the developing member; and a separation restraining member formed so that when the center moving member locates at the second position, the separation restraining member restrains the center moving member from moving from the second position, wherein when the process cartridge is installed along a guide rail of the image forming apparatus, the center moving member moves over the separation restraining member and to the first position.

Exemplary embodiments of the present general inventive also provide an image forming apparatus which may include a main body of the image forming apparatus, a process cartridge removably disposed in the main body, the process cartridge including a developing member, a photosensitive medium to face the developing member, a pair of supporting plates to rotatably support the developing member and the photosensitive medium, a center moving member rotatably disposed on the supporting plate, the center moving member having a first position in which the photosensitive medium contacts the developing member and a second position in which the photosensitive medium is spaced apart from the developing member, and a separation restraining member formed so that when the center moving member locates at the second position, the separation restraining member restrains the center moving member from moving from the second position, and a position changing member disposed in the main body so that when the process cartridge is separated from the main body, the position changing member causes the center moving member at the second position to move over the separation restraining member to the first position.

Exemplary embodiments of the present general inventive concept also provide an image forming apparatus, which may include a main body of the image forming apparatus, guide rails formed on opposite side surfaces of the main body, and a process cartridge removably disposed along the guide rails, wherein the process cartridge includes a developing member, a photosensitive medium to face the developing member, a pair of supporting plates to rotatably support the developing member and the photosensitive medium, a center moving member rotatably disposed on the supporting plate, the center moving member having a first position in which the photosensitive medium contacts the developing member and a second position in which the photosensitive medium is spaced apart from the developing member, and a separation restraining member formed so that when the center moving member locates at the second position, the separation restraining member restrains the center moving member from moving from the second position, and wherein when the process cartridge is installed into the main body along the guide rails, the center moving member moves from the second position to the first position over the separation restraining member.

Exemplary embodiments of the present general inventive concept also provide a developer having a developing member and a photosensitive medium usable with an image forming apparatus, the developer includes a center moving member movable between a first position in which the photosensitive medium is spaced apart from the developing member and a second position in which the photosensitive medium contacts the developing member, wherein the center moving member moves from the first position to the second position to form a developing nip when installed within the image forming apparatus.

The image forming apparatus may further include a separation restraining member to restrain the center moving member from moving from the second position after being installed within the image forming apparatus.

Exemplary embodiments of the present general inventive concept also provide a method to couple a process cartridge having a developing member and a photosensitive medium to an image forming apparatus, the method includes disposing the process cartridge within the image forming apparatus, wherein the developing member and the photosensitive medium are spaced apart from each other in a first position, and triggering a center moving member to allow the developing member to contact the photosensitive medium in a second position so that the image forming apparatus can function.

The method may further include restraining the center moving member at the first and/or second position with a separation restraining member.

Wherein the separation restraining member may include a rotation limiting portion to limit a range of motion of the center moving member and a restraining protrusion to restrain the center moving member from moving between the first position and the second position.

With a process cartridge according to an exemplary embodiment of the present general inventive concept having the structure as described above, separation restraining members restrain a center moving member from rotating so that even when a force or a shock is applied to the process cartridge from the outside during distribution thereof, a phenomenon in which the center moving member rotates to cause a photosensitive medium to contact a developing member does not occur.

Also, with a process cartridge according to an exemplary embodiment of the present general inventive concept having the structure as described above, separation restraining members restrain a center moving member from rotating. While an image forming apparatus in which a process cartridge is installed is being distributed, the center moving member is not rotated by a force or a shock which may be applied from the outside. Therefore, during distribution thereof, a phenomenon in which a photosensitive medium contacts a developing member does not occur.

BRIEF DESCRIPTION OF THE DRAWINGS

These and/or other aspects and utilities of the present general inventive concept will become apparent and more readily appreciated from the following description of the exemplary embodiments, taken in conjunction with the accompanying drawings of which.

DETAILED DESCRIPTION OF THE EMBODIMENTS

Figure 1:
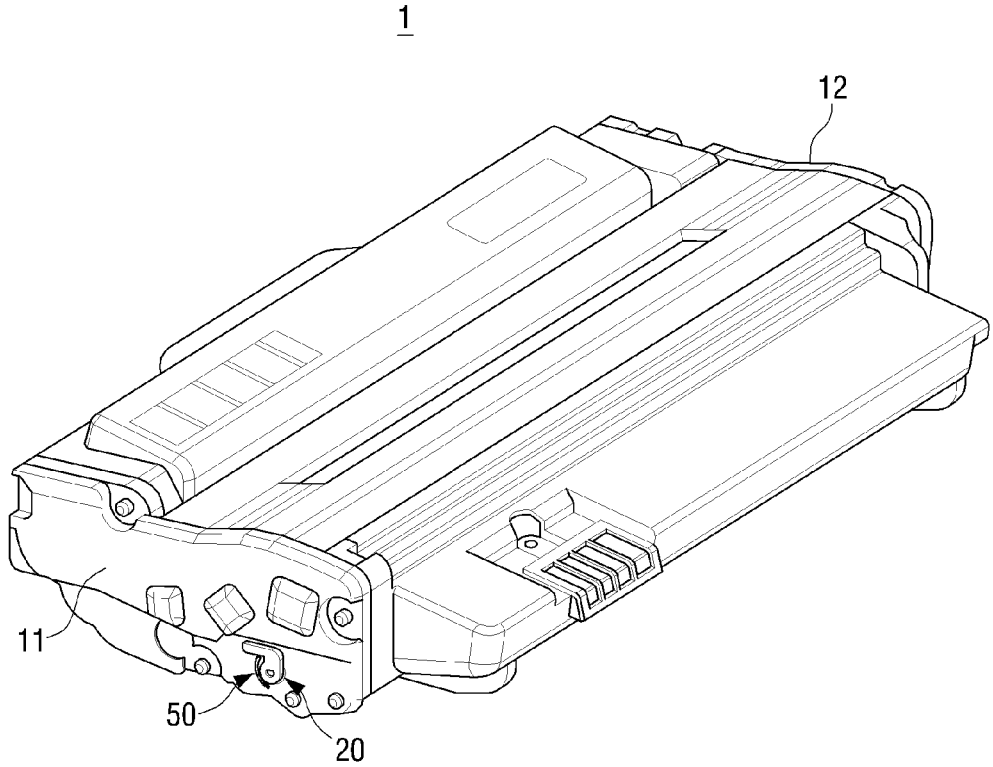
FIG. 1 is a perspective view illustrating a process cartridge usable with an image forming apparatus according to an exemplary embodiment of the present general inventive concept.

Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept by referring to the figures.

The matters defined in the description, such as a detailed construction and elements thereof, are provided to assist in a comprehensive understanding of the present general inventive concept. Thus, it is apparent that the present general inventive concept may be carried out without those defined matters. Also, well-known functions or constructions are omitted to provide a clear and concise description of exemplary embodiments described herein.

Figure 2:
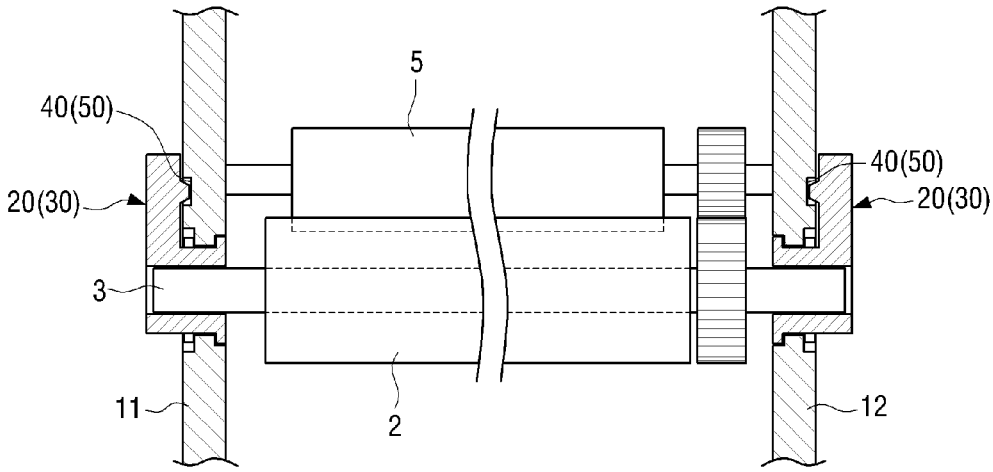
FIG. 2 is a partial cross-sectional view illustrating a center moving member used in a process cartridge usable with an image forming apparatus according to an exemplary embodiment of the present general inventive concept.

FIG. 1 is a perspective view illustrating a process cartridge 1 usable with an image forming apparatus 100 according to an exemplary embodiment of the present general inventive concept. FIG. 2 is a partial cross-sectional view illustrating a center moving member 20 used in a process cartridge 1 usable with an image forming apparatus 100 according to an exemplary embodiment of the present general inventive concept.

Referring to FIGS. 1 and 2, the process cartridge 1 usable with an image forming apparatus according to an exemplary embodiment of the present general inventive concept may include supporting plates 11 and 12, a developing member 5, a photosensitive medium 2, center moving members 20 and 30, and separation restraining members 40 and 50.

Figure 4:
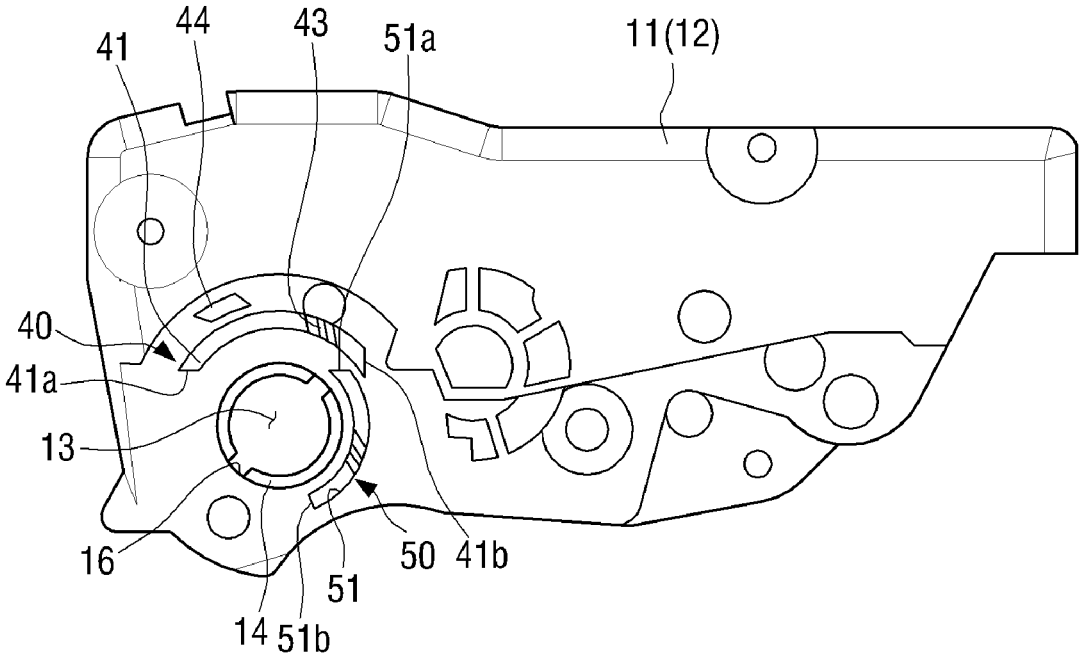
FIG. 4 is a side plan view illustrating a supporting plate used in the process cartridge of FIG. 1.

The supporting plates 11 and 12 may be provided as a pair to form opposite side surfaces of the process cartridge 1. The supporting plates 11 and 12 may rotatably support the developing member 5 and the photosensitive medium 2. An exemplary embodiment of the supporting plate 11 and 12 is illustrated in FIG. 4. The supporting plate 11 may be formed to rotatably support a supplying roller 7 (see FIG. 24), an agitator 9 (see FIG. 24), etc. in addition to the developing member 5 and the photosensitive medium 2.

The developing member 5 may supply developer to an electrostatic latent image formed on the photosensitive medium 2 to develop the electrostatic latent image into a visible image and may be disposed to rotate while facing the photosensitive medium 2. As illustrated in FIG. 2, a cylindrical developing roller may be used as the developing member 5.

The photosensitive medium 2 may be formed as a cylindrical photosensitive drum, and may be disposed to rotate with respect to a center shaft 3. The center shaft 3 may be fixed and supported by a pair of center moving members 20 and 30 that is rotatably disposed on the supporting plates 11 and 12. The center shaft 3 may be disposed with respect to the center moving member 20 and 30 so that when the photosensitive medium 2 rotates, the center shaft 3 does not rotate.

Figure 3:
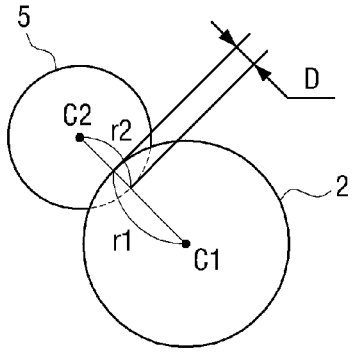
FIG. 3 is a schematic view illustrating a developing nip.

In the process cartridge 1 using a contact type developing method, the photosensitive medium 2 contacts the developing member 5 to form a developing nip D. Developer moves from the developing member 5 to the photosensitive medium 2 through the developing nip D. As illustrated in FIG. 3, the developing nip D may be expressed as an overlapping amount in a radial distance between the developing member 5 and the photosensitive medium 2. That is, the developing nip D an overlapping amount of a radius r2 of the developing member 5 and a radius r1 of the photosensitive medium 2 along on a straight line connecting a central axis C2 of the developing member 5 and a central axis C1 of the photosensitive medium 2. In the contact type developing method, a quality of a printed image may be sensitive to a variation of the developing nip D.

When the image forming apparatus 100 (see FIG. 24) is provided to a user, the process cartridge 1 may be provided in a first state in which the photosensitive medium 2 and the developing member 5 contact with each other. It may take a long period time from when the image forming apparatus 100 is manufactured until the user buys and uses the image forming apparatus 100. During the long period time, either of the developing member 5 and the photosensitive medium 2 or both may be deformed so that the developing nip D may be changed. Also, the developer in the developing nip D may adhere to either of the developing member 5 and the photosensitive medium 2 or both.

To solve such problems, the process cartridge 1 may be packaged independently from a main body 101 of the image forming apparatus 100 in a second state in which the developing member 5 is spaced apart from the photosensitive medium 2 and may be provided to the user in the second state. Then the user mounts the process cartridge 1 to the main body 101 of the image forming apparatus 100 so that the developing member 5 and the photosensitive medium 2 contact each other to form the developing nip D. That is, when the user mounts the process cartridge 1 having the developing member 5 and the photosensitive medium 2 spaced apart from each other into the image forming apparatus 100, the photosensitive medium 2 contacts the developing member 5 to form the developing nip D. However, in this method, since when the process cartridge 1 is installed in the main body 101 of the image forming apparatus 100 the developing nip D can not be separated, the process cartridge 1 should be packaged separately from the main body 101 of the image forming apparatus 100 for the distribution of the image forming apparatus 100.

As another method to solve such problems, the process cartridge 1 may be installed in the main body 101 of the image forming apparatus 100 in the second state in which the photosensitive medium 2 and the developing member 5 are spaced apart from each other and may be distributed in that state. In other words, after the process cartridge 1 of which the photosensitive medium 2 and the developing member 5 are spaced apart from each other is installed in the main body 101 during the manufacturing process, the process cartridge 1 may be distributed in that state. In this case, although shock and/or vibration may be applied to the image forming apparatus 100 during distribution, the process cartridge 1 should be configured so that the photosensitive medium 2 and the developing member 5 maintain spaced apart from each other. That is, the process cartridge having the photosensitive medium 2 spaced apart from the developing medium 5 is installed within the image forming apparatus 100 during a manufacturing process thereof and prior to distribution. After buying the image forming apparatus 100, the user separates the process cartridge 1 from the image forming apparatus 100 before using the image forming apparatus 100 so that the photosensitive medium 2 and the developing member 5 contact each other to form the developing nip D. Then, the user reinstalls the process cartridge 1 in the main body 101 so that the process cartridge 1 is in a state capable of forming images.

That is, when the user reinstalls the process cartridge 1 into the image forming apparatus 100, the photosensitive medium 2 and the developing member 5 contact each other to form the developing nip D, so that the image forming apparatus 100 can function to form images on printing medium.

Furthermore, after developer of the process cartridge 1 installed in the image forming apparatus 100 is completely consumed, the user buys a new process cartridge 1 and installs it in the main body 101 of the image forming apparatus 100. In this case, the process cartridge 1 is packaged and distributed in the second state in which the photosensitive medium 2 and the developing member 5 are spaced apart from each other. Also, although shock and/or vibration may be applied to the image forming apparatus 100 during distribution, the process cartridge 1 may be configured so that the photosensitive medium 2 and the developing member 5 maintain spaced apart from each other. Therefore, after the user installs the new process cartridge 1 in the main body 101 of the image forming apparatus 100, the developing member 5 and the photosensitive medium 2 contact each other to form the developing nip D.

As described above, the process cartridge 1 may be classified as two types according to the method to contact the developing member 5 with the photosensitive medium 2. One type of the process cartridge 1 may be provided to the user with the image forming apparatus 100. This type of process cartridge 1 may be configured so that when the process cartridge 1 is first installed in the image forming apparatus 100, the developing member 5 and the photosensitive medium 2 do not contact each other. When the user separates the process cartridge 1 from the image forming apparatus 100 and then reinstalls the process cartridge 1, the developing member 5 and the photosensitive medium 2 contact each other to form the developing nip D. This type process cartridge 1 is hereinafter referred to as a first cartridge type (i.e., a mounted process cartridge). The other type of process cartridge 1 may be provided to the user independently from the image forming apparatus 100 in a state in which the photosensitive medium 2 and the developing member 5 are spaced apart from each other. The process cartridge 1 may be configured so that when the process cartridge 1 is first installed in the image forming apparatus 100, the photosensitive medium 2 and the developing member 5 contact each other to form the developing nip D. This type of process cartridge 1 is hereinafter referred to as a second cartridge type (i.e., a sale process cartridge).

The center moving member 20 and 30 is a member used to cause the photosensitive medium 2 and the developing member 5 to be spaced apart from each other or to contact each other. The center moving members 20 and 30 may allow the photosensitive medium 2 to move to either a first position in which the photosensitive medium 2 contacts the developing member 5 or to a second position in which the photosensitive medium 2 is spaced apart from the developing member 5.

However, the present general inventive concept is not limited thereto. That is, in alternative exemplary embodiments, a first position of the center moving members 20 and 30 may refer to a state in which the developing member 5 and the photosensitive medium 2 are spaced apart from each other and a second position of the center moving members 20 and 30 may refer to a state in which the developing member 5 contacts the photosensitive medium 2 to form a developing nip D.

The separation restraining members 40 and 50 may restrain the center moving member 20 and 30 from getting out of the first position or the second position. In other words, when the center moving member 20 and 30 locates at either the first position or the second position, the separation restraining members 40 and 50 may prevent or restrain the center moving member 20 and 30 from moving from the first or second positions to the second or first positions, respectively.

Hereinafter, the center moving members 20 and 30 and the separation restraining members 40 and 50 for the first cartridge type and the second cartridge type will be explained in detail. For convenience of explanation, the center moving member 20 and 30 and the separation restraining member 40 and 50 are classified as for the mounted process cartridge and for the sale process cartridge. However, the center moving member 20 and 30 and the separation restraining member 40 and 50 used in both process cartridges 1 may have the same and/or substantially similar features as described below.

Figure 5:
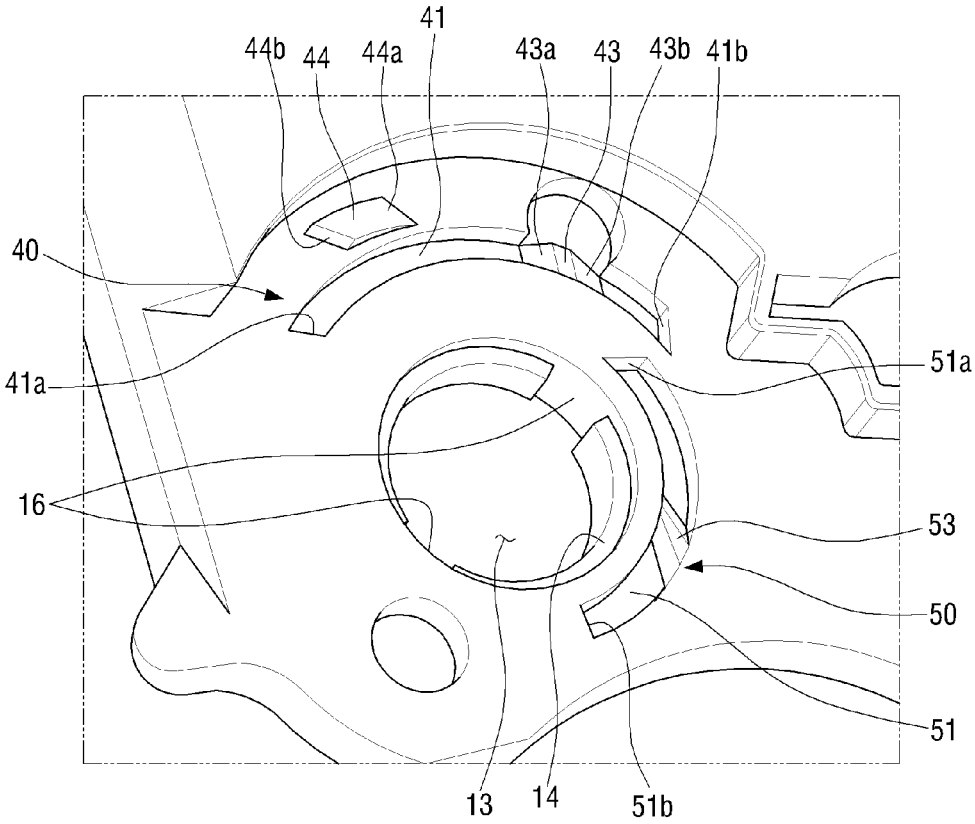
FIG. 5 is a partial perspective view illustrating a separation restraining member formed on the supporting plate of FIG. 4.
Figure 6:
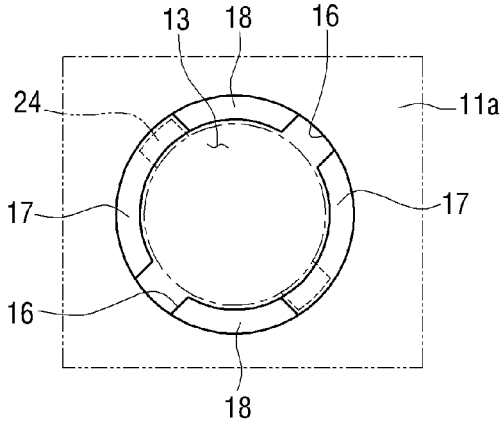
FIG. 6 is a partial view illustrating a rear surface of a supporting hole of the supporting plate of FIG. 4.
Figure 7:
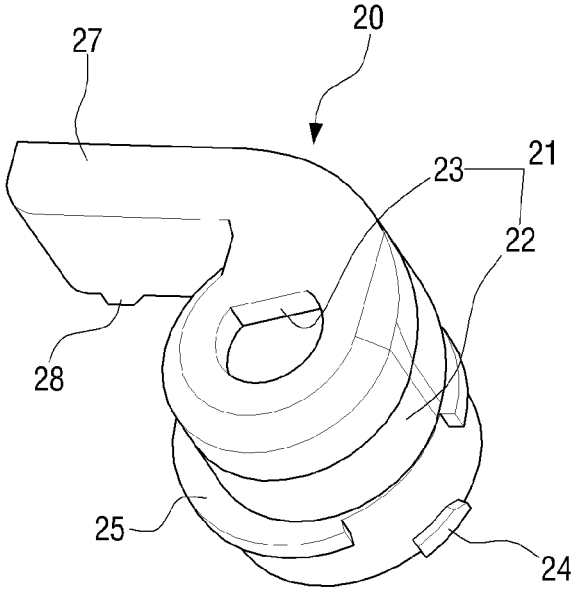
FIG. 7 is a perspective view illustrating a mounted center moving member used in a process cartridge usable with an image forming apparatus according to an exemplary embodiment of the present general inventive concept.
Figure 8:
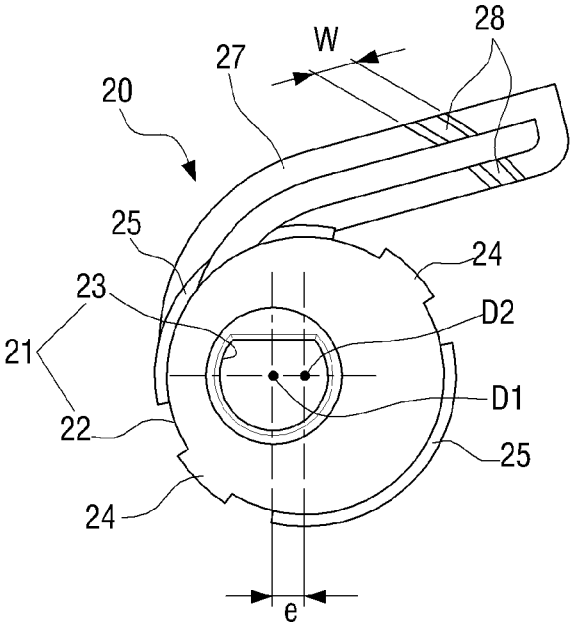
FIG. 8 is a rear view illustrating the mounted center moving member of FIG. 7.
Figure 9:
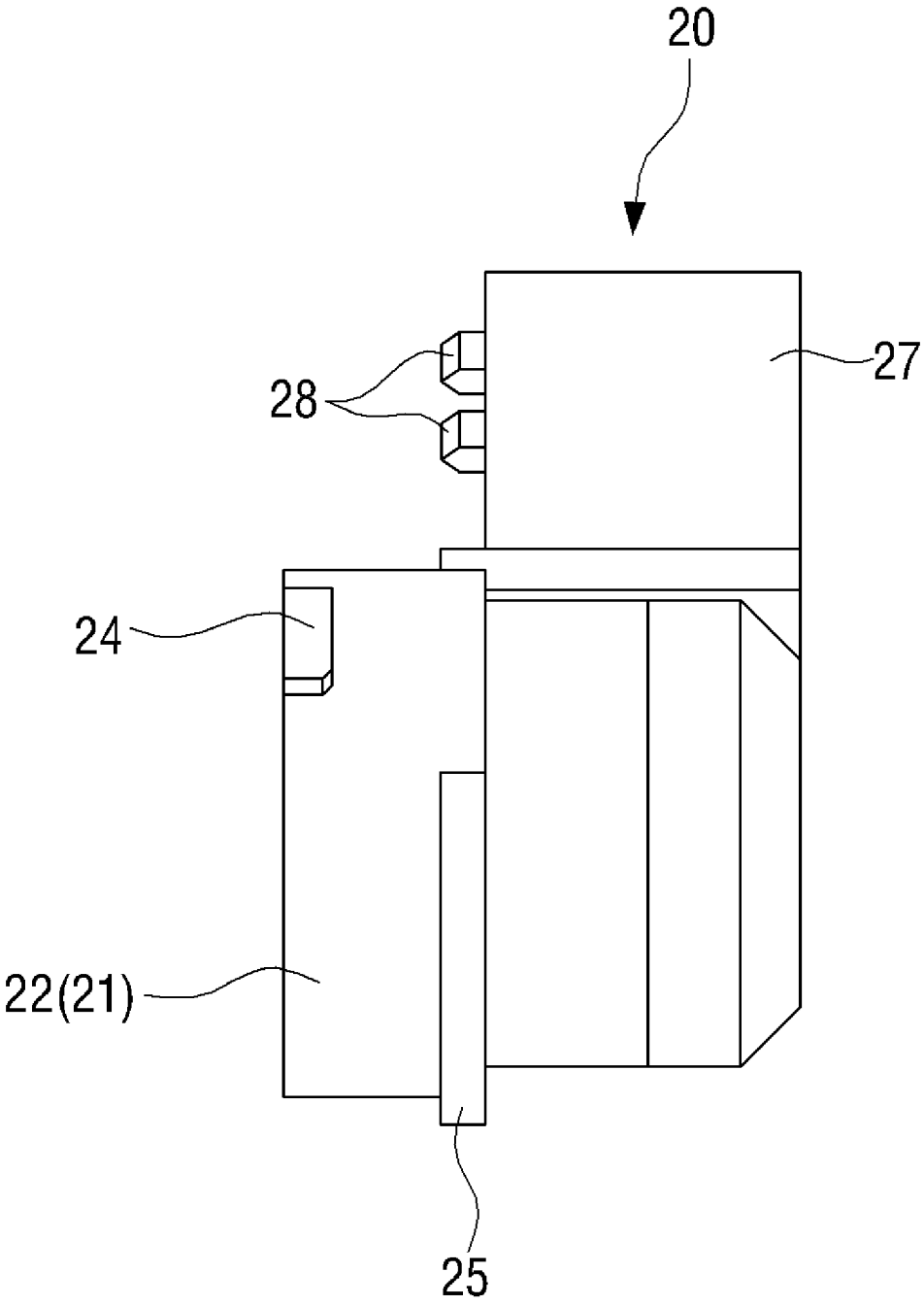
FIG. 9 is a side view illustrating the mounted center moving member of FIG. 7.
Figure 10:
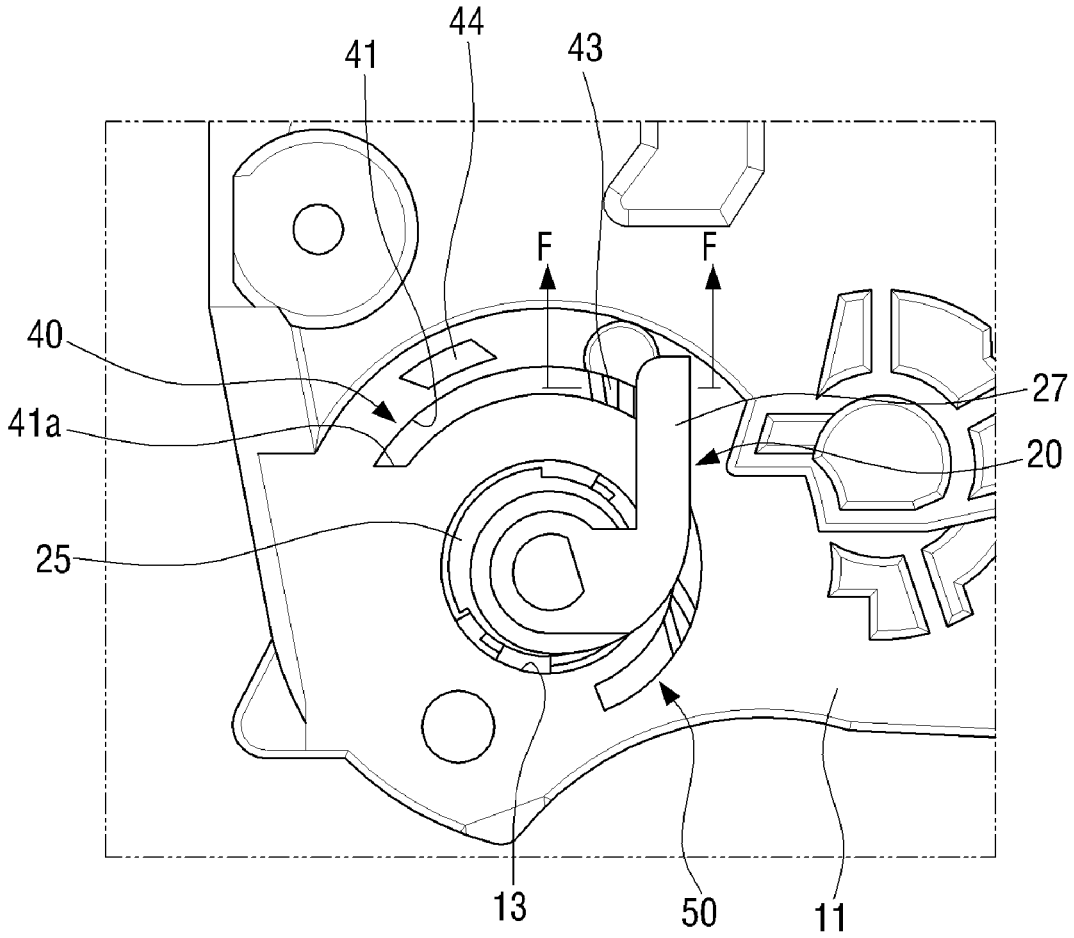
FIG. 10 is a partial plan view illustrating a mounted center moving member of a process cartridge usable with an image forming apparatus that locates at a second position.
Figure 11:
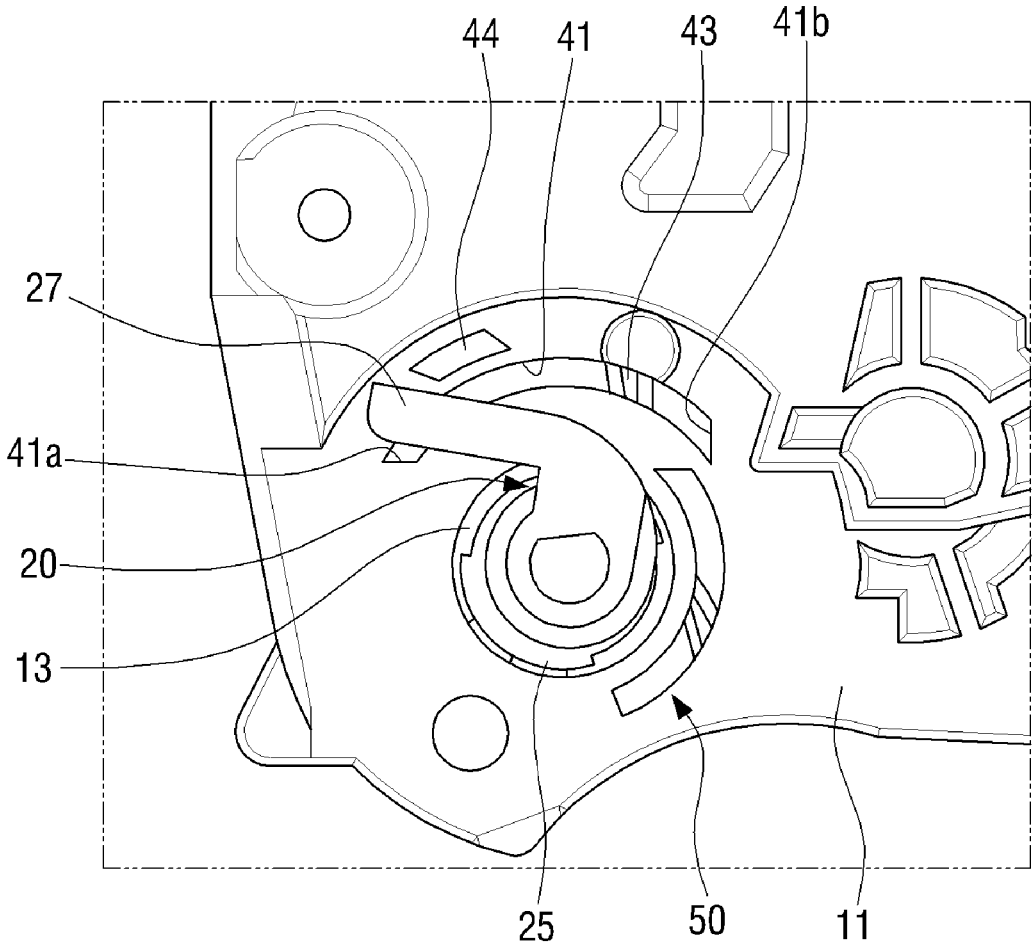
FIG. 11 is a partial plan view illustrating a mounted center moving member of a process cartridge usable with an image forming apparatus that locates at a first position.

FIG. 4 is a side plan view illustrating the supporting plate 11 used in the process cartridge 1 according to an exemplary embodiment of the present general inventive concept. FIG. 5 is a partial perspective view illustrating the separation restraining members 40 and 50 formed on the supporting plate 11 of FIG. 4. FIG. 6 is a partial view illustrating a rear surface of a supporting hole 13 of the supporting plate 11 of FIG. 4. FIGS. 7, 8, and 9 are a perspective view, a rear view, and a side view illustrating the center moving member 20 (hereinafter, referred to as a mounted center moving member) used in the process cartridge 1 usable with an image forming apparatus according to an exemplary embodiment of the present general inventive concept.

Referring to FIGS. 7 to 9, the mounted center moving member 20 of the process cartridge 1 according to an exemplary embodiment of the present general inventive concept may include a bushing 21 and a lever 27 which extends outward from the bushing 21.

Figure 15:
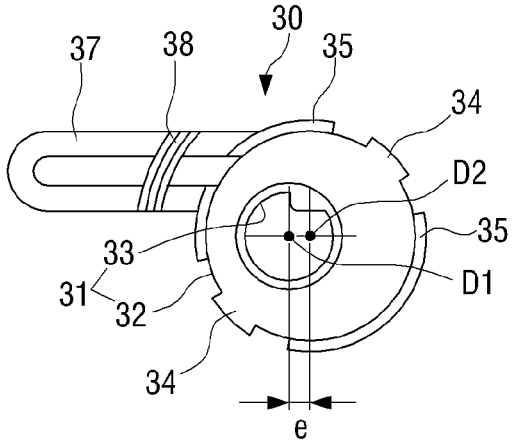
FIG. 15 is a rear view illustrating the sale center moving member of FIG. 14.
Figure 16:
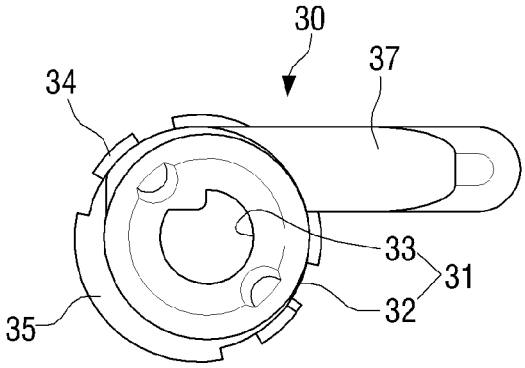
FIG. 16 is a side view illustrating the sale center moving member of FIG. 14.

The bushing 21 may be formed in a cylindrical shape having axial centers D2 and D1 of an outer circumferential portion 22 and an inner circumferential portion 23, respectively, that do not coincide with each other. In other words, the bushing 21 is, as illustrated in FIG. 8, formed so that the axial centers D2 and D1 of the outer circumferential portion 22 and the inner circumferential portion 23 are eccentric from each other by a predetermined distance "e." The inner circumferential portion 23 of the bushing 21 is formed inside the outer circumferential portion 22. An end of the center shaft 3 of the photosensitive medium 2 is inserted into and secured to the inner circumferential portion 23 of the bushing 21 (see FIG. 2). The inner circumferential portion 23 may be formed so that the center shaft 3 of the photosensitive medium 2 does not rotate with respect to the inner circumferential portion 23 of the bushing 21. For example, as illustrated in FIGS. 7 and 8, the inner circumferential portion 23 may be formed in a "D" shape, and the end of the center shaft 3 may be formed in a shape which corresponds to the "D" shape. Also, as illustrated in FIGS. 15 and 16, the inner circumferential portion 33 may be formed to have a projecting portion of an "L" shape, and the end of the center shaft 3 may be formed to have a shape which corresponds to the "L" shape. Also, in exemplary embodiments, the inner circumferential portion 23 and the end of the center shaft 3 may be connected or coupled to each other by a key (not illustrated). However, the present general inventive concept is not limited thereto. That is, the inner circumferential portion 23 of the bushing 21 may be formed in various other shapes as long as it can prevent the center shaft 3 from rotating with respect to the inner circumferential portion 23.

The outer circumferential portion 22 of the bushing 21 may be formed to be inserted into and to rotate with respect to the supporting hole 13 of the supporting plate 11 and 12. Also, an escape preventing protrusion 24 and an insert limiting protrusion 25 may be formed on the outer circumferential portion 22 of the bushing 21.

The escape preventing protrusion 24 may be formed on an end portion of the outer circumferential portion 22 near an inner surface 11*a* of the supporting plate 11, that is, on the end portion of the outer circumferential portion 22 which is inserted in the supporting hole 13 of the supporting plate 11, to thereby prevent the center moving member 20 from falling out of the supporting hole 13 of the supporting plate 11. The escape preventing protrusion 24 may be formed in various shapes as long as it can prevent the bushing 21 from falling out of the supporting hole 13. In the present exemplary embodiment, the escape preventing protrusion 24, as illustrated in FIGS. 7 and 8, is formed in a substantially bar shape having a length which corresponds to a circumferential length of the outer circumferential portion 22 of about 20 degrees to about 30 degrees. Also, in exemplary embodiments, as illustrated in FIG. 8, two escape preventing protrusions 24 may be formed at an angular interval of 180 degrees apart from each other. The supporting hole 13 of the supporting plate 11, as illustrated in FIG. 5, may be formed with two inserting grooves 16 into which the two escape preventing protrusions 24 may be inserted. At least one guiding seat 17, as illustrated in FIG. 6, may be formed on the inner surface 11*a* of the supporting plate 11 along the outer circumference of the supporting hole 13 so that when the bushing 21 of the center moving member 20 rotates, the guiding seat 17 guides a movement of the escape preventing protrusion 24. The guiding seat 17 may have at least one stopper 18 to limit a range of rotation of the escape preventing protrusion 24. The stopper 18 causes the escape preventing protrusion 24 to rotate within a predetermined range of angles, that is, between a first position and a second position.

The insert limiting protrusion 25 may be formed on an end portion of the outer circumferential portion 22 of the bushing 21 near an outer surface of the supporting plate 11, that is, the end portion near a portion of the outer circumferential portion 22 connected with the lever 27. The insert limiting protrusion 25 may restrict a depth to which the center moving member 20 can be inserted into the supporting hole 13 of the supporting plate 11. That is, when the bushing 21 of the center moving member 20 is inserted into the supporting hole 13 of the supporting plate 11, the insert limiting protrusion 25 may prevent the bushing 21 from being inserted to a deep position. As long as the insert limiting protrusion 25 can prevent the bushing 21 from being inserted into the supporting hole 13 to the deep position, it may be formed in various other shapes. In the present exemplary embodiment, as illustrated in FIGS. 7 and 8, the insert limiting protrusion 25 is formed in a bent bar shape and is positioned along the outer circumferential portion 22. The insert limiting protrusion 25 may be formed to enclose an entire circumference of the outer circumferential portion 22. However, in exemplary embodiments, portions of the insert limiting protrusion 25 which correspond to the escape preventing protrusion 24 may be cut, as illustrated in FIG. 7, so that when the bushing 21 is inserted into the supporting hole 13, the escape preventing protrusion 24 being inserted into the inserting groove 13 can be seen. At least one guiding portion 14, as illustrated in FIG. 5, may be formed on the outer surface of the supporting plate 11 along the outer circumference of the supporting hole 13 so that when the bushing 21 of the center moving member 20 rotates, the guiding portion 14 guides a movement of the insert limiting protrusion 25.

Figure 12:
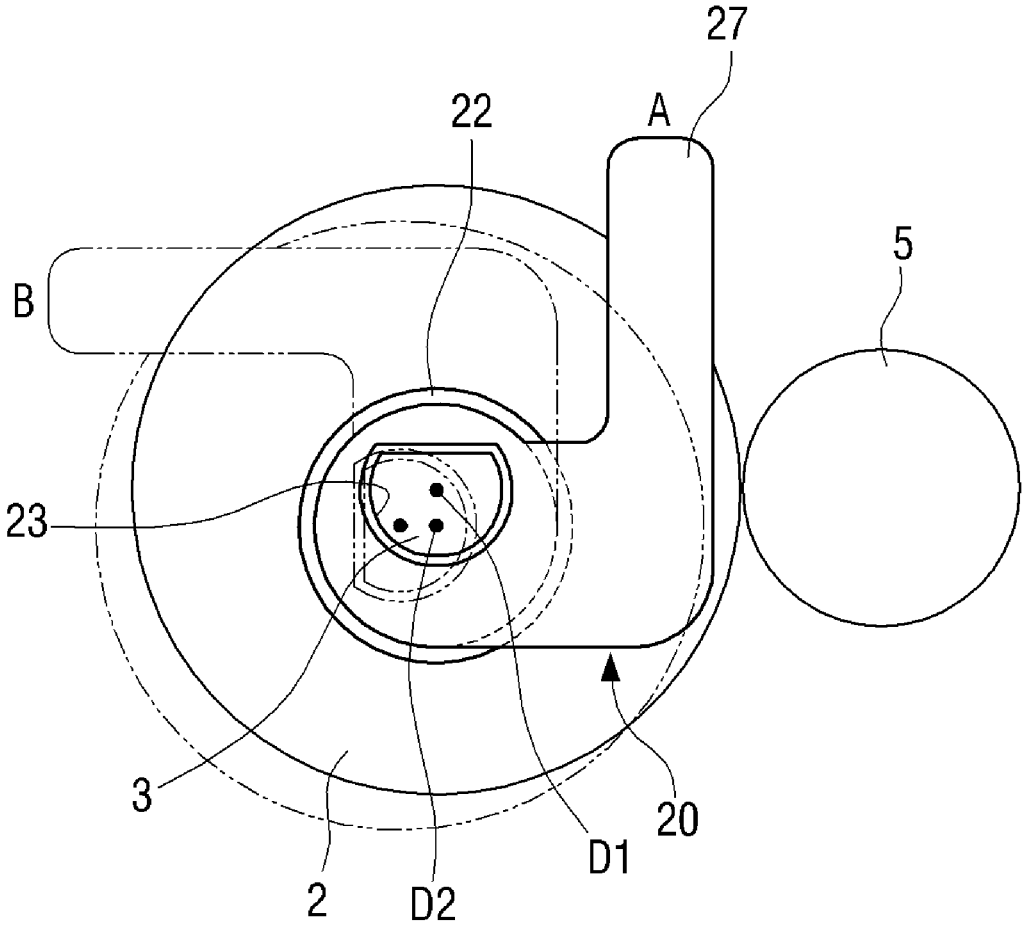
FIG. 12 is a view illustrating operation of a mounted center moving member of a process cartridge usable with an image forming apparatus.

The lever 27 may be formed to extend outward from an end of the outer circumferential portion 22 of the bushing 21, that is, the end of the outer circumferential portion 22 of the bushing 21 which projects from the outer surface of the supporting plate 11. The lever 27 may transmit an external force to cause the bushing 21 to rotate by a predetermined angle. Therefore, when the lever 27 rotates by a predetermined angle, the bushing 21 is also rotated by the same angle with respect to the supporting hole 13 of the supporting plate 11. As illustrated in FIG. 12, when the lever 27 rotates from an "A" position (the second position) to a "B" position (the first position), the bushing 21 is rotated so that the photosensitive medium 2 contacts the developing member 5. On the contrary, when the lever 27 rotates from the "B" position to the "A" position, the center moving member 20 is moved from the first position to the second position so that the photosensitive medium 2 may be separated from the developing member 5. A surface of the lever 27, that is, a surface of the lever 27 facing the supporting plate 11 may be formed with a guiding projection 28 that is inserted into and moves along a guiding groove 41 of the supporting plate 11.

The separation restraining member 40 may restrain the center moving member 20 located at either the first position or the second position from escaping from either the first position or the second position by shock and/or vibration applied from an external source. Especially, after the center moving member 20 is set to the second position, that is, in the state in which the photosensitive medium 2 is spaced apart from the developing member 5, the separation restraining member 40 can prevent the center moving member 20 from moving from the second position to the first position, in which the photosensitive medium 2 contacts the developing member 5, by mistake during packaging or by shock and/or vibration during the distribution of the process cartridge 1. The separation restraining member 40 may include a rotation limiting portion 41 and at least one restraining protrusion 43 and 44.

The rotation limiting portion 41 may be formed on the surface of the supporting plate 11 and may limit the range of rotation of the center moving member 20. In other words, the rotation limiting portion 41 limits a rotation range of the center moving member 20 so that the center moving member 20 can move between the first position and the second position. The rotation limiting portion 41 may be a guiding groove 41 having a predetermined depth formed on the outer surface or the surface of the supporting plate 11 to guide a rotation of the center moving member 20. The guiding groove 41 may be formed in a circular arc centered on the center of the supporting hole 13 with a width which corresponds to a width W of the guiding projection 28 of the lever 27 as illustrated in FIGS. 4 and 5, so that when the center moving member 20 rotates, the guiding projection 28 formed on the lever 27 of the center moving member 20 can be inserted into and can move along the guiding groove 41. Therefore, a first end 41*a* of the guiding groove 41 may correspond to the first position of the center moving member 20, and a second end 41*b* of the guiding groove 41 may correspond to the second position of the center moving member 20. As a result, when the guiding projection 28 is interrupted by the first end 41*a* of the guiding groove 41, the center moving member 20 locates at the first position such that the photosensitive medium 2 contacts the developing member 5. When the lever 27 is rotated in a reverse direction so that the guiding projection 28 of the lever 27 is interrupted by the second end 41*b* of the guiding groove 41, the center moving member 20 locates at the second position so that the photosensitive medium 2 is spaced apart from the developing member 5.

In FIGS. 4 and 5, a first groove of a circular arc shape disposed above the supporting hole 13 of the supporting plate 11 is a first guiding groove 41 to guide the lever 27 of the center moving member 20 of the mounted process cartridge 1 (that is, the mounted center moving member). The second groove of a circular arc shape disposed at a side of the supporting hole 13 (at the right side of supporting hole 13 in FIGS. 4 and 5) is a second guiding groove 51 to guide the lever 37 of the center moving member 30 of the sale process cartridge 1 (that is, the sale center moving member). In the present exemplary embodiment, for convenience of manufacturing, as illustrated in FIGS. 4 and 5, all of the first and second guiding grooves 41 and 51 are formed on the supporting plate 11. However, in exemplary embodiments, the mounted process cartridge 1 may have the supporting plate 11 on which only the first guiding groove 41 is formed, and the sale process cartridge 1 may include a supporting plate 11 on which only the second guiding groove 51 is formed.

The at least one restraining protrusion 43 and 44 may be formed on the outer surface of the supporting plate 11 and may restrain the center moving member 20 from moving from the first position to the second position and from the second position to the first position. That is, in exemplary embodiments, the restraining protrusion may include a contact restraining protrusion 43 and a separation restraining protrusion 44.

Figure 13:
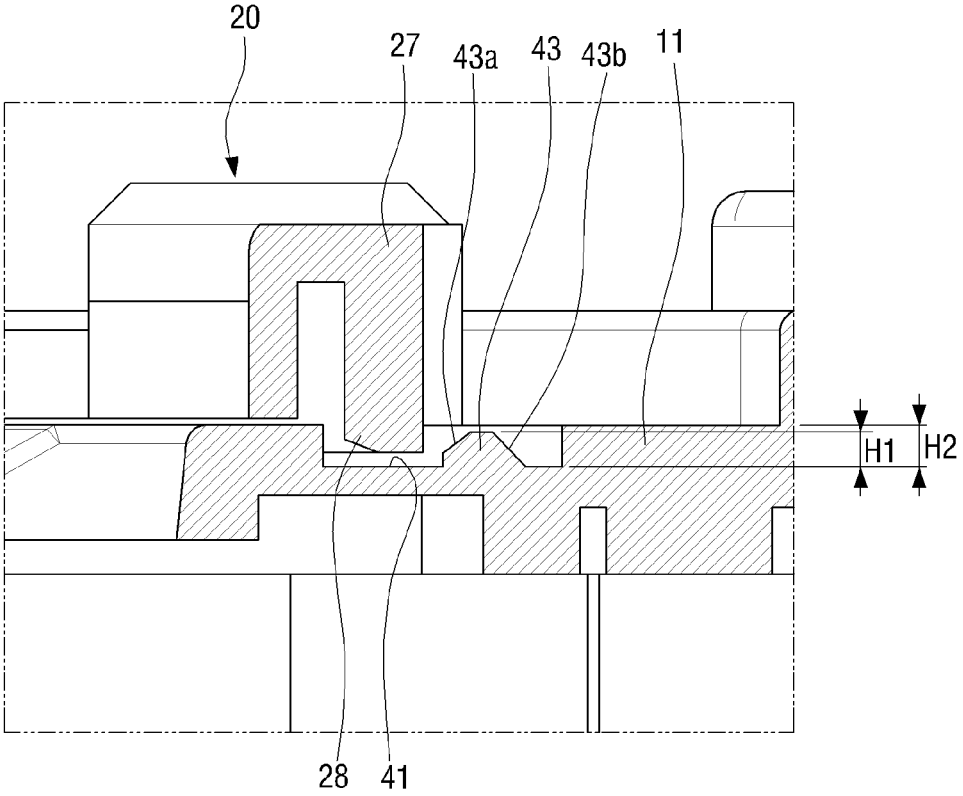
FIG. 13 is a partial cross-sectional view illustrating the mounted center moving member of FIG. 10 taken along line 13-13 in FIG. 10.

The contact restraining protrusion 43 restrains the lever 27 of the center moving member 20 from moving from the second end 41*b* of the first guiding groove 41 toward the first end 41*a* thereof, thereby preventing the photosensitive medium 2 and the developing member 5 which are spaced apart from each other from contacting each other to form the developing nip D. The contact restraining protrusion 43, as illustrated in FIG. 5, may be formed to interfere with the guiding projection 28 of the lever 27 of the center moving member 20 inside the first guiding groove 41. The contact restraining protrusion 43, as illustrated in FIG. 13, may be formed in an inclined protrusion. In exemplary embodiments, when a depth of the first guiding groove 41 is approximately 1 mm, a height of the contact restraining protrusion 43 is about 0.7 mm. Opposite inclined planes 43*a* and 43*b* of the contact restraining protrusion 43 may be formed to have different slopes as illustrated in FIG. 13. For example, an entering inclined plane 43*a* along which the guiding projection 28 enters the second end 41*b* may be formed to have the height of about 0.7 mm and a length of about 1.2 mm to about 1.5 mm. Also, an exiting inclined plane 43*b* along which the guiding projection 28 exits from the second end 41*b* may be formed to have a height and a length of about 0.7 mm. However, in the above explanation, the height and length of the contact restraining protrusion 43 are only exemplary embodiments and are not intended to be limit the present general inventive concept. The contact restraining protrusion 43 may be formed in various sizes as long as it can block or prevent the center moving member 20 from being rotated by a small force applied from an external source, for example, a force applied to the center moving member 20 by mistake of a worker when the worker packages the process cartridge 1, shock and/or vibration applied to the process cartridge 1 during distribution thereof, etc. However, the contact restraining protrusion 43 may be formed so that when the process cartridge 1 is separated from and is installed into the image forming apparatus 100, the guiding projection 28 of the lever 27 of the center moving member 20 can be moved over the contact restraining protrusion 43 by a force being applied by a position changing member 90 (see FIG. 20) disposed in the image forming apparatus 100.

When the center moving member 20 locates at the first position, that is, when the lever 27 of the center moving member 20 locates at the first end 41*a* of the first guiding groove 41, the separation restraining protrusion 44 restrains the lever 27 of the center moving member 20 from moving from the first end 41*a* toward the second end 41*b*. As illustrated in FIG. 5, the separation restraining protrusion 44 may be formed to interfere with a side surface of the lever 27 on the supporting plate 11 outside the first guiding groove 41. At this time, an entering slant portion 44*a* of the separation restraining protrusion 44 along which the lever 27 moves from the first end 41*a* toward the second end 41*b* may be formed to have a length several times a height thereof as illustrated in FIG. 5. In exemplary embodiments, a length of the entering slant portion 44*a* may be about 2 or 6 times a height thereof. However, as illustrated in FIG. 5, an exiting slant portion 44*b* of the separation restraining protrusion 44 may be formed substantially perpendicular to an outer surface of the supporting plate 11 to prevent the lever 27 of the center moving member 20 from moving from the first end 41*a* toward the second end 41*b*. That is, in exemplary embodiments, the separation restraining protrusion 44 may be formed to have a triangular section. The exiting slant portion 44*b* of the separation restraining protrusion 44 facing the first end 41*a* of the first guiding groove 41 may be formed substantially vertical in order for the lever 27 of the center moving member 20 not to move toward the second end 41*b* of the first guiding groove 41, and the entering slant portion 44*a* of the separation restraining protrusion 44 facing the second end 41*b* of the first guiding groove 41 may be formed in an inclined surface so that the lever 27 can move toward the first end 41*a* of the first guiding groove 41. When the center moving member 20 locates at the first position so that the photosensitive medium 2 and the developing member 5 contact each other, the separation restraining protrusion 44 prevents the lever 27 from rotating. Therefore, even when shock and/or vibration is applied from the external source, the center moving member 20 does not move from the first position.

On the other hand, in exemplary embodiments, there may be a predetermined positional relationship between the lever 27, the escape preventing protrusion 24 of the center moving member 20, and the inserting groove 16 of the supporting hole 13 to prevent the center moving member 20 from falling out of the supporting hole 13 when the lever 27 of the center moving member 20 rotates. The lever 27, the escape preventing protrusion 24, and the inserting groove 16 may be formed to have a positional relationship in that when the lever 27 of the center moving member 20 locates beyond the second end 41*b* of the first guiding groove 41, the escape preventing protrusion 24 can be inserted into the inserting groove 16, and then the lever 27 is rotated by a small angle toward the first end 41*a* of the first guiding groove 41 so the guiding projection 28 of the lever 27 may be inserted into the first guiding groove 41 and the escape preventing protrusion 24 may be inserted into the guiding seat 17 so that the center moving member 20 may be rotatably connected in the supporting hole 13 of the supporting plate 11. As a result, when the lever 27 locates at the second end 41*b* of the first guiding groove 41, the center moving member 20 does not fall out of the supporting hole 13.

Figure 14:
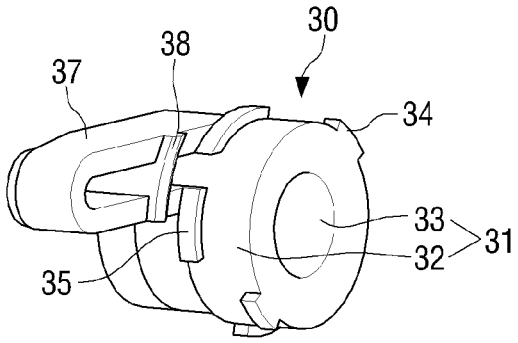
FIG. 14 is a perspective view illustrating a sale center moving member used in a process cartridge usable with an image forming apparatus according to an exemplary embodiment of the present general inventive concept.

FIGS. 14, 15, and 16 are a perspective view, a rear view, and a front view illustrating the center moving member 30 (hereinafter, referred to as a sale center moving member) used in the sale process cartridge 1 according to an exemplary embodiment of the present general inventive concept.

Referring to FIGS. 14 to 16, the sale center moving member 30 may include a bushing 31 and a lever 37. The bushing 31 may be formed to have an inner circumferential portion 33 to hold and support the center shaft 3 of the photosensitive medium 2 and an outer circumferential portion 32 that is rotatably inserted in the supporting hole 13 of the supporting plate 11. The axial centers D1 and D2 of the outer circumferential portion 32 and the inner circumferential portion 33, respectively, are eccentric from each other by a predetermined distance "e." The bushing 31 may be the same as or substantially similar to that of the mounted center moving member 20 used to the mounted process cartridge 1 as described above. Therefore, a detailed explanation thereof is omitted.

Also, the bushing 31 may include an escape preventing protrusion 34 to prevent the sale center moving member 30 from falling out of the supporting hole 13 of the supporting plate 11 and an insert limiting protrusion 35 to limit a depth to which the sale center moving member 30 is inserted into the supporting hole 13 which is formed on the outer circumferential portion 32 thereof. Thus, the bushing 31 is substantially similar to the busing 21 of the above-described mounted center moving member 20.

The lever 37 may be formed to extend outwardly from the outer circumferential portion 32 of the bushing 31. While the process cartridge 1 is being installed into the main body 101 of the image forming apparatus 100, the lever 37 may be operated by a guide rail 102 of the main body 101 to rotate the center moving member 30. On the contrary, the above-described mounted center moving member 20 is formed so that the lever 27 is operated by the position changing member 90 disposed in the main body 101 of the image forming apparatus 100. Therefore, the lever 37 of the sale center moving member 30 may be formed in various different shapes from the lever 27 of the mounted center moving member 20. In the present exemplary embodiment, as illustrated in FIGS. 7, 8, 14, 15, and 16, the levers 27 and 37 of the mounted center moving member 20 and the sale center moving member 30 are formed in different shapes from each other.

The lever 37 of the sale center moving member 30 may have a guiding projection 38, which is inserted in and is guided by the second guiding groove 51 formed on the supporting plate 11, that is formed on a surface of the lever 37. The guiding projection 38 may be formed as a circular arc centering on the axial center D2 of the outer circumferential portion 32. The second guiding groove 51 may be formed as a groove of a circular arc shape centering on the center of the supporting hole 13 at a side of the supporting hole 13 (at the right side of supporting hole 13 in FIGS. 4 and 5) on the supporting plate 11. The second guiding groove 51 may have a depth of about 1 mm. A first end 51*a* of the second guiding groove 51 may correspond to the first position of the center moving member 30, and a second end 51*b* of the second guiding groove 51 may correspond to the second position of the center moving member 30. As a result, when the guiding projection 38 of the lever 37 is interrupted by the first end 51*a* of the second guiding groove 51, the center moving member 30 locates at the first position to allow the photosensitive medium 2 to contact the developing member 5. When the lever 37 is rotated in a reverse direction so that the guiding projection 38 of the lever 37 is interrupted by the second end 51*b* of the second guiding groove 51, the sale center moving member 30 locates at the second position in which the photosensitive medium 2 is spaced apart from the developing member 5.

A contact restraining protrusion 53 may be formed inside the second guiding groove 51. The contact restraining protrusion 53 does not allow the lever 37 located at the second end 51*b* to escape from the second end 51*b* of the second guiding groove 51 by a small force which may be applied to the sale process cartridge 1 during a distribution thereof. However, when the sale process cartridge 1 is mounted in the main body 101 of the image forming apparatus 100, the contact restraining protrusion 53 allows the lever 37 to escape from the second end 51*b* of the second guiding groove 51 and to move toward the first end 51*a*. Therefore, the guiding projection 38 of the lever 37 of the center moving member 30 and the contact restraining protrusion 53 of the second guiding groove 51 may be formed to satisfy the following conditions. When the lever 37 locates at the second end 51*b*, the guiding projection 38 of the lever 37 cannot go over the contact restraining protrusion 53 by a force applied to the center moving member 30 by mistake of a worker during packaging or by shock and/or vibration applied to the process cartridge 1 during distribution thereof, etc. However, when the process cartridge 1 is inserted along the guide rail 102 of the main body 101 of the image forming apparatus 100, the guiding projection 38 of the lever 37 can be moved over the contact restraining protrusion 53 by a weight of the process cartridge 1'. For this, the contact restraining protrusion 53 may be formed as an inclined surface to interfere with the guiding projection 38 of the lever 37. The contact restraining protrusion 53 formed as the inclined surface may be the same as or substantially similar to the contact restraining protrusion 43 of the mounted process cartridge 1 as described above. Therefore, a detailed explanation thereof is omitted.

Figure 17:
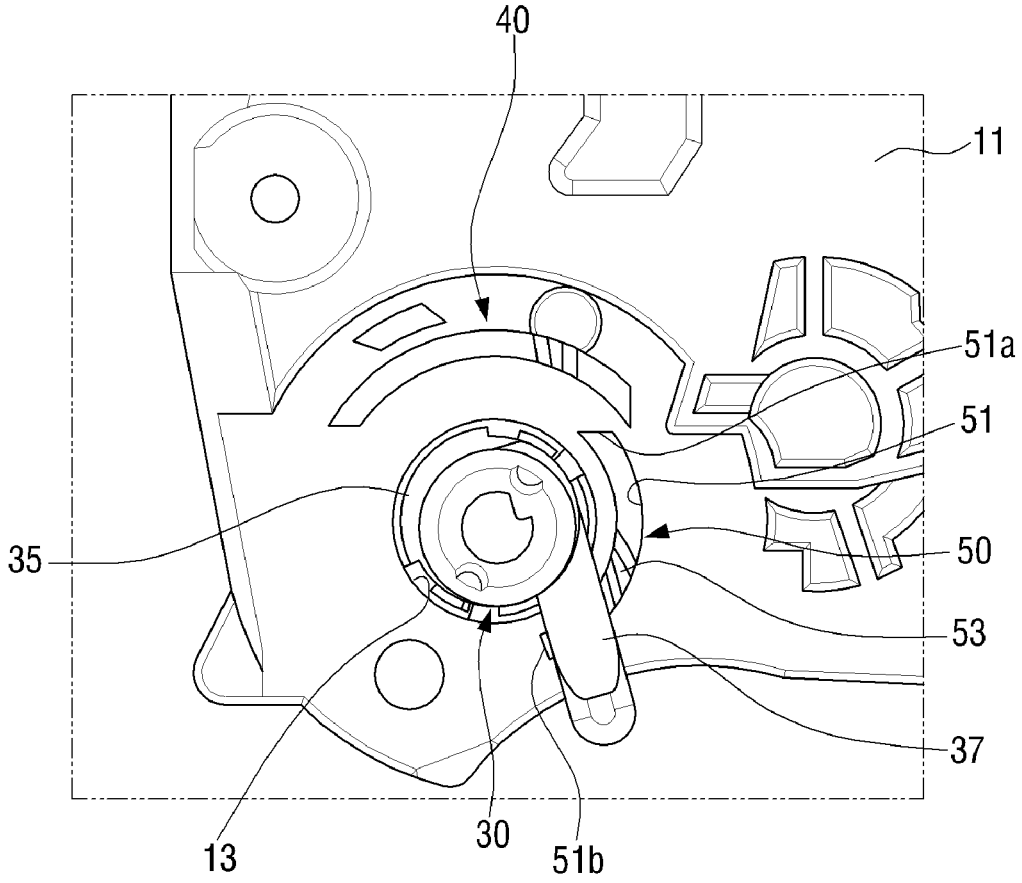
FIG. 17 is a partial perspective view illustrating a sale center moving member of a process cartridge usable with an image forming apparatus that locates at a second position.
Figure 18:
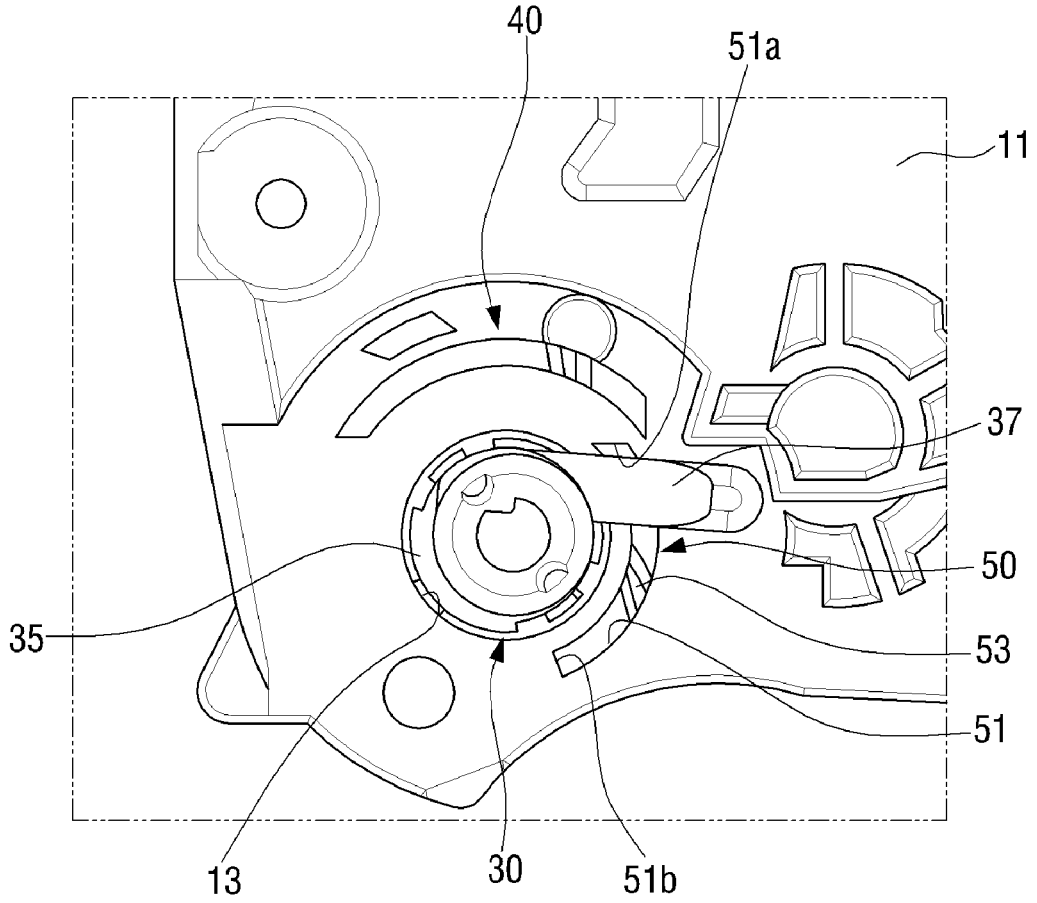
FIG. 18 is a partial perspective view illustrating a sale center moving member of a process cartridge usable with an image forming apparatus that locates at a first position.
Figure 19:
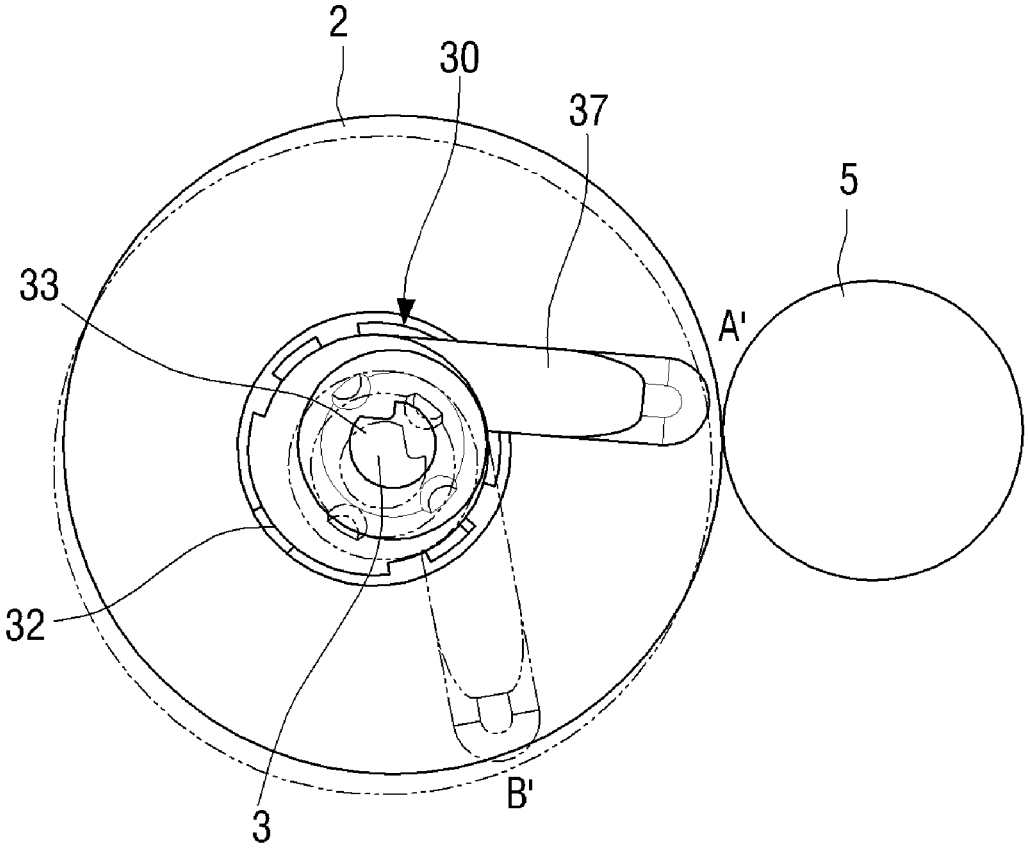
FIG. 19 is a view illustrating operation of a sale center moving member of a process cartridge usable with an image forming apparatus.

As a result, when the lever 37 of the center moving member 30 of the sale process cartridge 1' locates at the second end 51*b* of the second guiding groove 51 as illustrated in FIG. 17, the center moving member 30 locates at the second position so that the photosensitive medium 2 is maintained to be spaced apart from the developing member 5 (indicated by the dashed dotted line in FIG. 19). When the sale process cartridge 1' is installed in the main body 101 of the image forming apparatus 100, the lever 37 of the center moving member 30 is rotated in a counterclockwise direction by the guide rail 102, to thereby move over the contact restraining protrusion 53 toward the first end 51*a* of the second guiding groove 51. When the lever 37 locates at the first end 51*a* of the second guiding groove 51 as illustrated in FIG. 18, the center moving member 30 locates at the first position so the photosensitive medium 2 contacts the developing member 5 to form the developing nip D (indicated by the solid line in FIG. 19).

Furthermore, in exemplary embodiments, the lever 37, the escape preventing protrusion 34 of the center moving member 30, and the inserting groove 16 of the supporting hole 13 may have a predetermined positional relationship to prevent the center moving member 30 from falling out of the supporting hole 13 in the sale process cartridge 1'. The positional relationship between the lever 37 and escape preventing protrusion 34 of the center moving member 30 and the inserting groove 16 of the supporting hole 13 of the sale process cartridge 1' may be determined similar to that between the lever 27 and escape preventing protrusion 24 of the center moving member 20 and the inserting groove 16 of the supporting hole 13 of the mounted process cartridge 1, as described above. Therefore, a detailed explanation thereof is omitted for convenience.

Hereinafter, when the process cartridge 1 and 1' usable with an image forming apparatus 100 according to an exemplary embodiment of the present general inventive concept having the above-described structure is installed into the main body 101 of the image forming apparatus 100, operation of the center moving member 20 and 30 and the separation restraining members 40 and 50 will be explained.

Figure 21A:
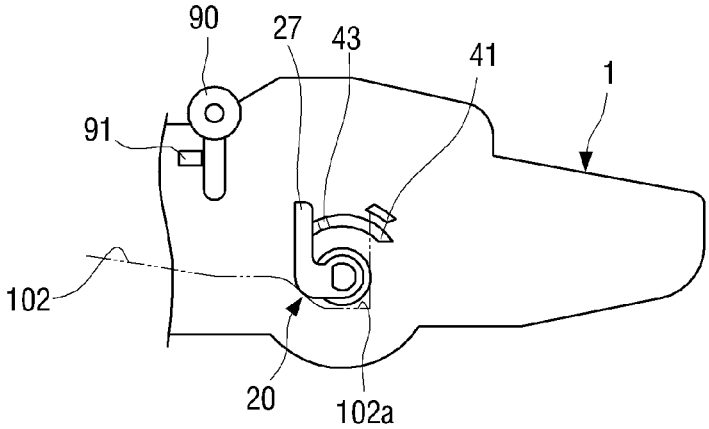
FIGS. 21A, 21B, and 21C are views illustrating movement of a mounted center moving member when a process cartridge according to an exemplary embodiment of the present general inventive concept is separated from a main body of an image forming apparatus.

The mounted process cartridge 1 may be distributed in a state in which the mounted process cartridge 1 is installed in the image forming apparatus 100 after the photosensitive medium 2 and the developing member 5 are spaced apart from each other during manufacturing. In other words, the mounted process cartridge 1, as illustrated in FIG. 21A, is installed in a seating recess 102*a* of the main body 101 of the image forming apparatus 100 in a state in which the lever 27 of the center moving member 20 locates at the second end 41*b* of the first guiding groove 41, and is distributed with the image forming apparatus 100. At this time, a movement of the lever 27 of the center moving member 20 is restrained or controlled by the contact restraining protrusion 43. That is, although a worker touches the center moving member 20 by mistake when mounting the process cartridge 1 or shock and/or vibration is applied to the image forming apparatus 100, the center moving member 20 does not rotate from the second end 41*b* of the first guiding groove 41. In other words, the photosensitive medium 2 which is spaced apart from the developing member 5 is prevented from contacting the developing member 5 by a mistake by the worker or by a shock during the distribution thereof, etc.

In general, the process cartridge 1 provided to the user may have a protection film to protect the photosensitive medium 2, an isolation film to isolate a developer storing chamber 8 from a developer receptacle (not illustrated) coupled to the process cartridge 1 to supply developer to the developer storing chamber 8, etc. Therefore, before using the image forming apparatus 100 to print, the user is required to remove various protecting members, such as the protection film, the isolation film, etc., from the process cartridge 1.

Figure 21B:
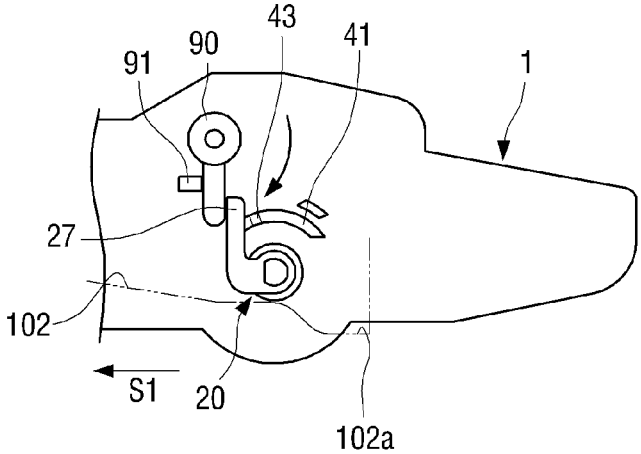
Figure 21C:
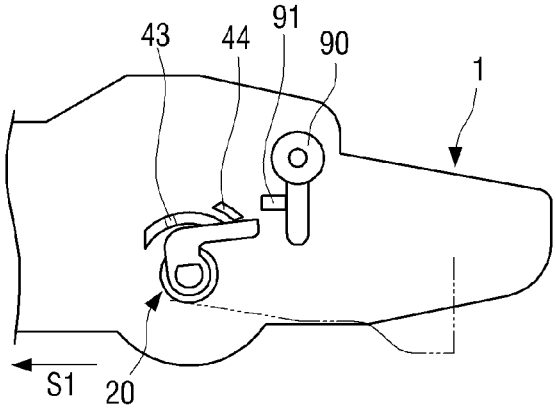

Therefore, when the user buys the image forming apparatus 100, he or she must first separate the process cartridge 1 from the main body 101 of the image forming apparatus 100. While the process cartridge 1 is being separated along the guide rail 102 in direction "S1", the lever 27 of the center moving member 20, as illustrated in FIG. 21B, interferes with the position changing member 90 disposed in the main body 101 of the image forming apparatus 100. The lever 27 interferes with the position changing member 90 to receive a force in a clockwise direction. The guiding projection 28 of the lever 27 can be moved over the contact restraining protrusion 43 by the force applied to the lever 27 by the position changing member 90. After the lever 27 of the center moving member 20 moves away from the position changing member 90, the lever 27 locates at the first end 41*a* of the first guiding groove 41, as illustrated in FIG. 21C. When the lever 27 locates at the first end 41*a* of the first guiding groove 41, the center moving member 20 locates at the first position so the photosensitive medium 2 contacts the developing member 5 to form the developing nip D.

The user removes various protecting members from the separated process cartridge 1, and then reinstalls the process cartridge 1 into the main body 101 of the image forming apparatus 100. Before the process cartridge 1 is mounted, the lever 27 of the center moving member 20, as illustrated in FIG. 21C, locates at the first end 41*a* of the first guiding groove 41. Therefore, the process cartridge 1 can then be installed since the lever 27 of the center moving member 20 does not interfere with the position changing member 90.

Figure 20:
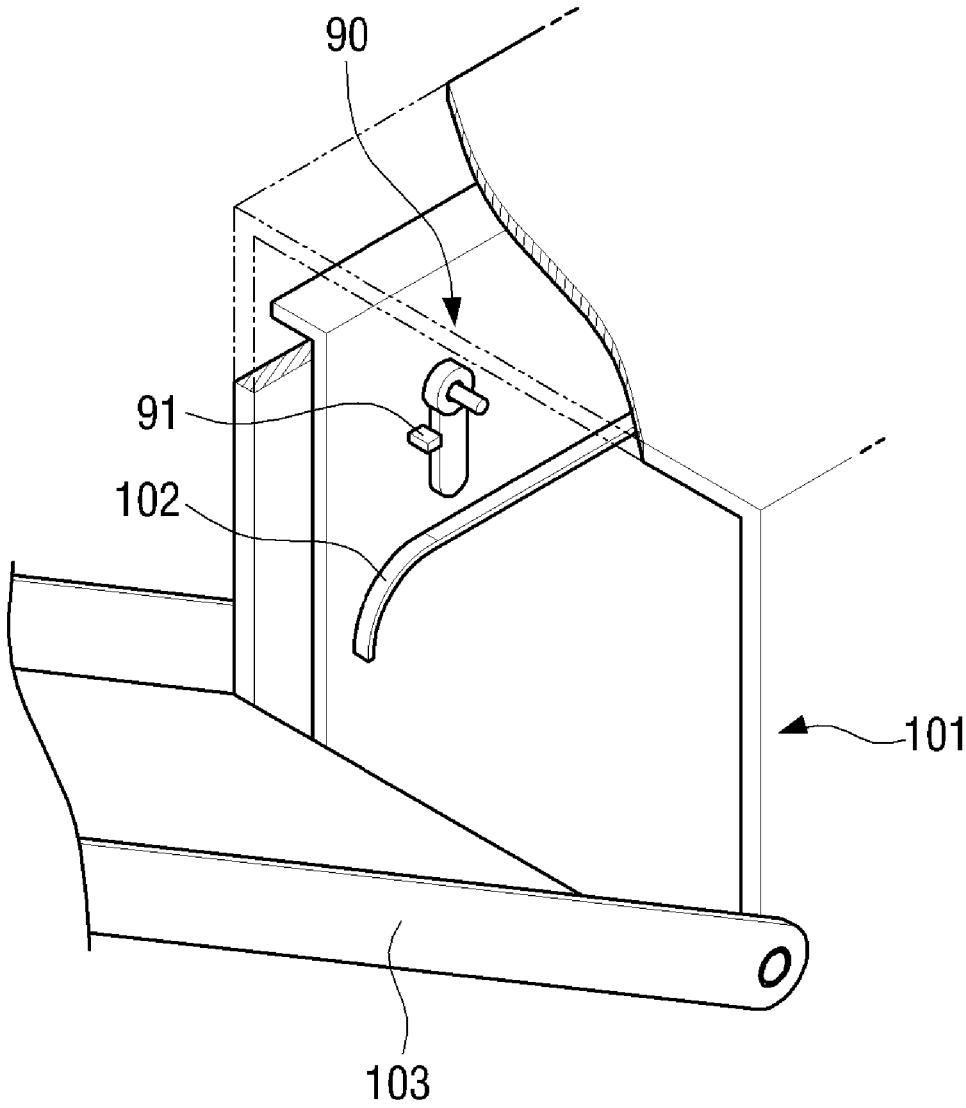
FIG. 20 is a partial perspective view illustrating a position changing member disposed in an image forming apparatus.

The position changing member 90 may be disposed in the main body 101 of the image forming apparatus 100 as illustrated in FIG. 20. The position changing member 90 may be formed so that the clockwise rotation of the center moving members 20 and 30 is blocked by a stopping projection 91 and the counterclockwise rotation of the center moving members 20 and 30 is free. Therefore, when the process cartridge 1 is separated from the main body 101, the lever 27 of the center moving member 20 receives the force applied by the position changing member 90 so as to be rotated. However, when the process cartridge 1 is installed into the main body 101, even if the lever 27 of the center moving member 20 interferes with the position changing member 90, the position changing member 90 rotates freely in the counterclockwise direction so that the lever 27 does not receive a force by the position changing member 90. Therefore, only by the manipulation of the user by removing and reinstalling the process cartridge 1 in the main body 101, does the photosensitive medium 2 contact the developing member 5 to form the developing nip D.

When the lever 27 of the center moving member 20 locates at the first end 41*a* of the first guiding groove 41, the rotation of the lever 27 is prevented by the separation restraining protrusion 44 which is formed above the first guiding groove 41. Therefore, even when shock is applied to the image forming apparatus 100, a phenomenon in that the center moving member 20 of the process cartridge 1 rotates to allow the photosensitive medium 2 to be spaced apart from the developing member 5 may not occur.

Figure 23A:
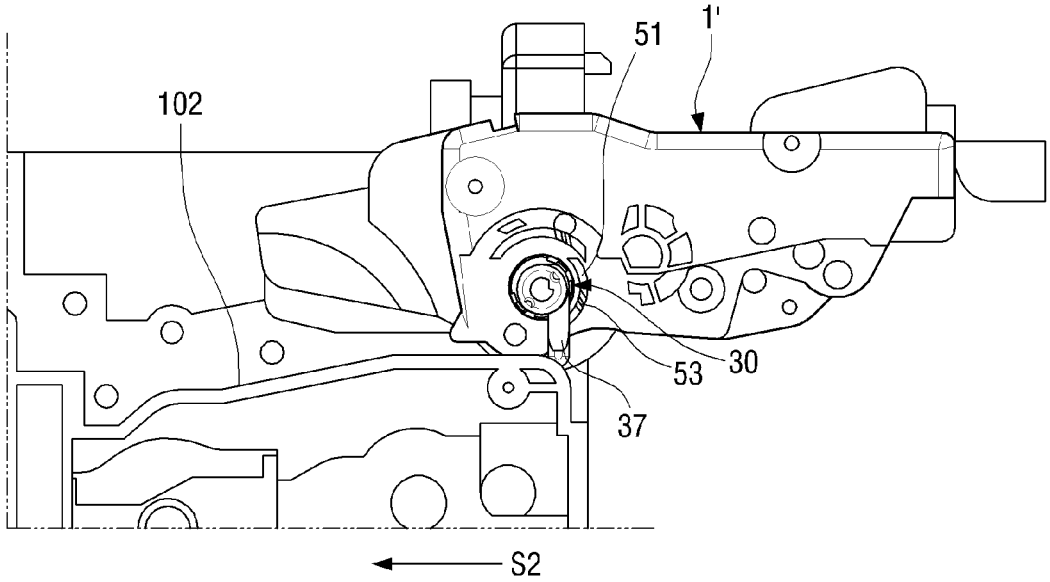
FIGS. 23A, 23B, and 23C are views illustrating movement of a sale center moving member when a process cartridge according to an exemplary embodiment of the present general inventive concept is separated from a main body of an image forming apparatus.

After the process cartridge 1 that has been installed in the image forming apparatus 100 from when the user bought the image forming apparatus 100 reaches the end of its operational life span, the user buys and uses a new process cartridge, that is, a sale process cartridge 1'. The sale process cartridge 1' is packaged and distributed with the photosensitive medium 2 and the developing member 5 spaced apart from each other. In other words, the sale process cartridge 1' is packaged and distributed in a state in which the lever 37 of the center moving member 30 locates at the second end 51*b* of the second guiding groove 51 as illustrated in FIG. 23A. In this state, the guiding projection 38 of the lever 37 of the center moving member 30 interferes with the contact restraining protrusion 53 of the second guiding groove 51. Therefore, although the worker touches the center moving member 30 by mistake when packaging the process cartridge 1' or a shock and/or vibration is applied to the process cartridge 1' during distribution thereof, the lever 37 of the center moving member 30 does not rotate to escape from the second end 51*b* of the second guiding groove 51. In other words, a phenomenon in that the photosensitive medium 2 spaced apart from the developing member 5 is caused to contact with the developing member 5 by either mistake of the worker or shock during distribution may not occur.

Figure 23B:
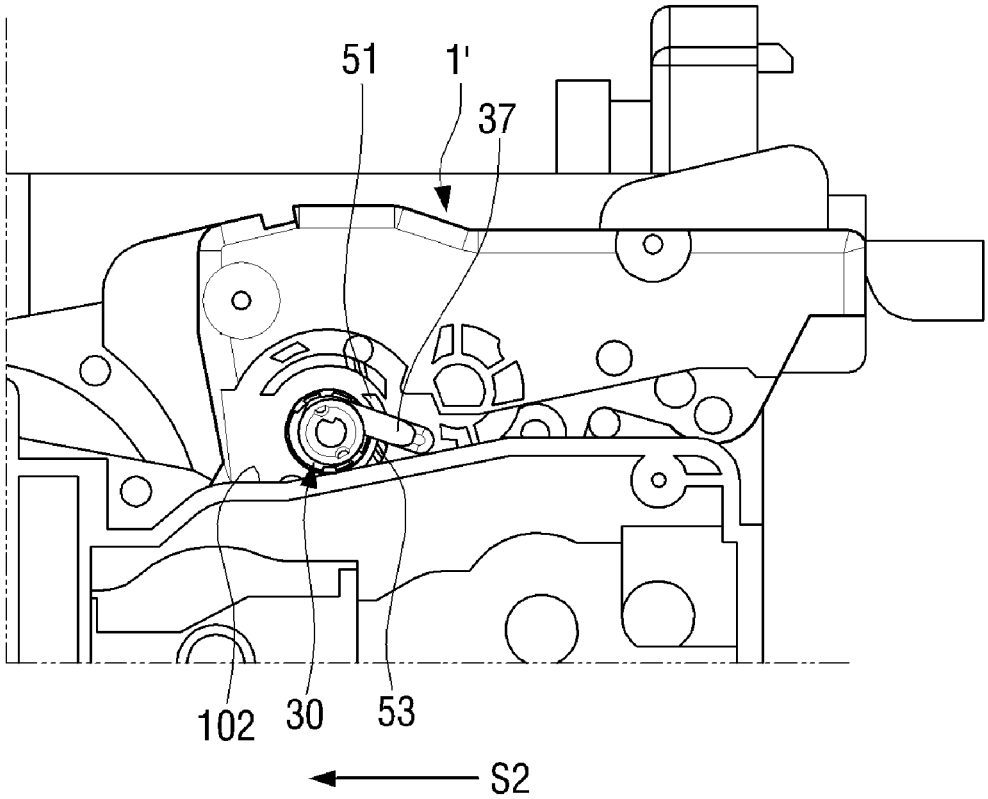
Figure 23C:
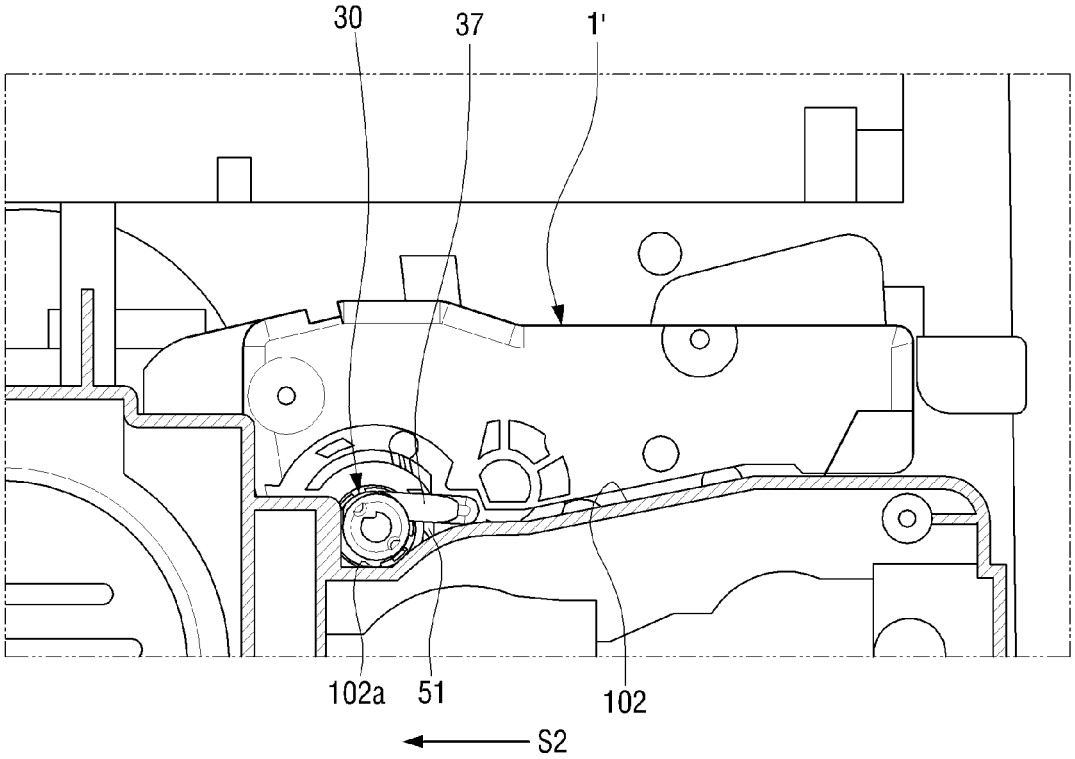

The user may install the sale process cartridge 1', which he or she bought, along the guide rail 102 of the main body 101 of the image forming apparatus 100 (direction "S2" of FIGS. 23A-C). The user puts a portion of the process cartridge 1' on the guide rail 102 and inserts it in to some extent so the lever 37 of the center moving member 30, as illustrated in FIG. 23A, contacts the guide rail 102. The deeper the process cartridge 1' is inserted, the larger amount of angle the lever 37 of the center moving member 30, as illustrated in FIG. 23B, rotates by moving along the second guiding groove 51 in the counterclockwise direction. When the process cartridge 1' is completely installed, the bushing 31 of the center moving member 30 locates at the seating recess 102*a* and the lever 37 locates at the first end 51*a* of the second guiding groove 51. When the lever 37 of the center moving member 30 locates at the first end 51*a* of the second guiding groove 51, the center moving member 30 locates at the first position so the photosensitive medium 2 contacts the developing member 5 to form the developing nip D. Therefore, the image forming apparatus 100 can normally perform a printing operation. At this time, since the lever 37 of the center moving member 30 is supported by the guide rail 102, even when the image forming apparatus 100 receives shock, vibration, etc., the center moving member 30 does not escape from the first position. In other words, a phenomenon in that the photosensitive medium 2 is spaced apart from the developing member 5 by shock from an external source would not occur during usage of the image forming apparatus 100.

Hereinafter, an example of the image forming apparatus 100 having the process cartridge 1 as described above will be explained with reference to FIG. 24.

Figure 24:
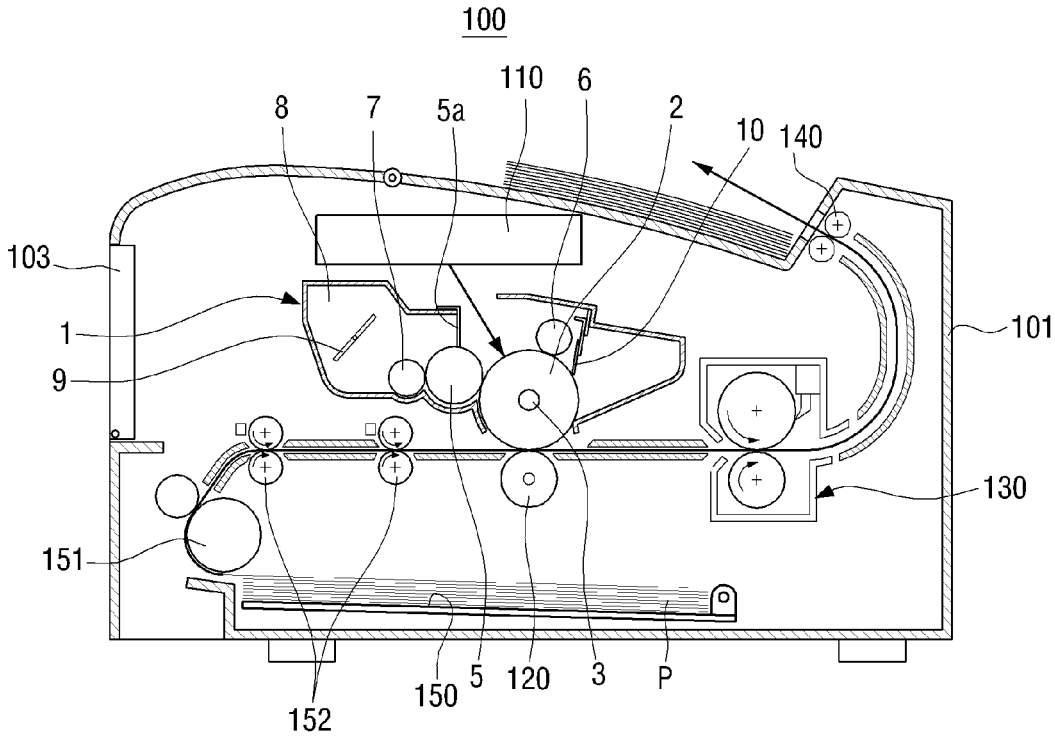
FIG. 24 is a cross-sectional view schematically illustrating an image forming apparatus in which a process cartridge according to an exemplary embodiment of the present general inventive concept is mounted.

FIG. 24 is a cross-sectional view schematically illustrating the image forming apparatus 100 in which the process cartridge 1 according to an exemplary embodiment of the present general inventive concept is mounted.

Referring to FIG. 24, the image forming apparatus 100 may include the main body 101, a process cartridge 1, an exposure unit 110, a transferring roller 120, a fusing unit 130, and a printing medium feeding unit 150.

Figure 22:
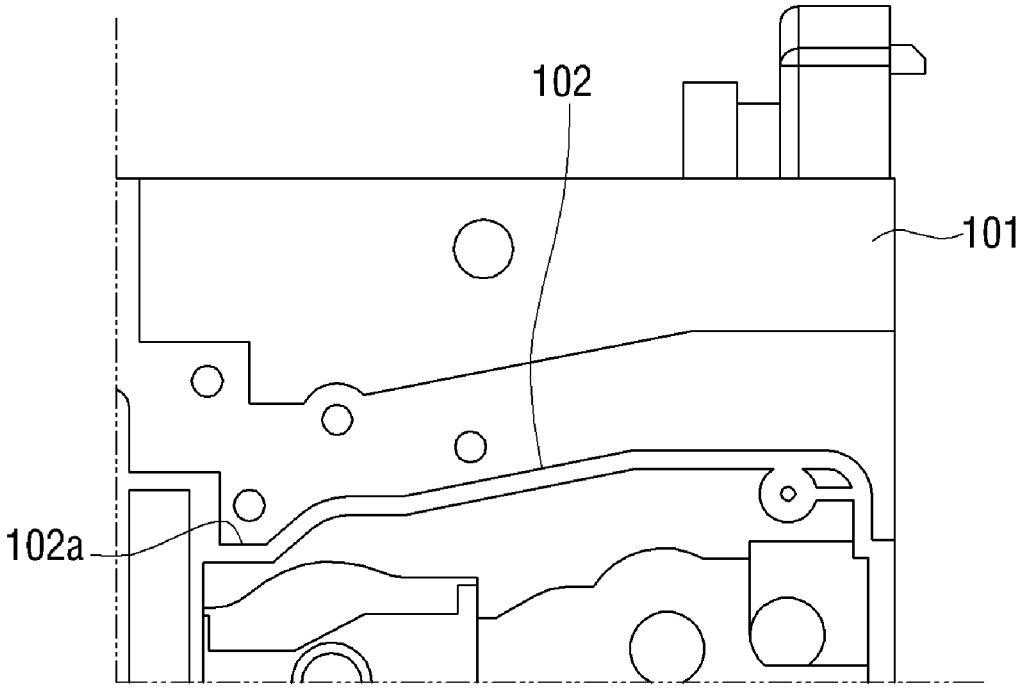
FIG. 22 is a partial sectional view illustrating a guide rail disposed in an image forming apparatus.

The main body 101 may form an external appearance of the image forming apparatus 100, and may support the process cartridge 1, the exposure unit 110, the transferring roller 120, the fusing unit 130, and the printing medium feeding unit 150. The guide rail 102 may be disposed on opposite inner side surfaces to guide a mounting of the process cartridge 1 (see FIGS. 20 and 22). A door 103, through which the process cartridge 1 is installed and separated through, may be provided at the end of the guide rail 102 on a side surface of the main body 101.

The process cartridge 1 may include the photosensitive medium 2, a charging roller 6, the developing roller 5, and the developer storing chamber 8. The photosensitive medium 2 may be formed in a cylindrical shape. A photosensitive layer having photoconductivity may be formed on an outer circumferential surface of the photosensitive medium 2. The photosensitive medium 2 may be disposed to rotate with respect to the center shaft 3 fixed to the center moving member 30 which is rotatably disposed in the process cartridge 1. The charging roller 6 may charge the surface of the photosensitive medium 2 by a uniform electric potential. However, the present general inventive concept is not limited thereto. That is, in exemplary embodiments, a charging bias may be applied to the charging roller 6. A corona charging device (not illustrated) may be used instead of the charging roller 6. The developing roller 5 may supply developer stored in the developer storing chamber 8 to an electrostatic latent image formed on the surface of the photosensitive medium 2 to develop the electrostatic latent image into a visible image. The image forming apparatus 100 according to present exemplary embodiment may use the contact type developing method in that the developing roller 5 and the photosensitive medium 2 contact with each other to form a developing nip D. The developing roller 5 may be formed to have an elastic layer (not illustrated) formed on the outer circumferential surface of a conductive metallic core (not illustrated). When the developing bias is applied to the developing roller 5, developer moves and adheres to the electrostatic latent image on the surface of the photosensitive medium 2 through the developing nip D.

The process cartridge 1 may also be provided with a supplying roller 7 to attach the developer stored in the developer storing chamber 8 to the developing roller 5. A supplying bias may be applied to the supplying roller 7 to attach the developer to the developing roller 5. The process cartridge 1 also may be provided with an agitator 9 to supply the developer stored in the developer storing chamber 8 toward the developing roller 5. The agitator 9 may stir the developer stored in the developer storing chamber 8 to charge the developer by a predetermined electric potential. The process cartridge 1 may also be provided with a regulating member 5*a* to regulate and charge an amount of the developer that is attached on the surface of the developing roller 5 and that is supplied to the developing nip D. The process cartridge 1 may also have a cleaning member 10 to remove waste developer remaining on the surface of the photosensitive medium 2 after the developer is transferred onto a printing medium P.

The exposure unit 110 may scan a light modulated corresponding to a printing data to the photosensitive medium 2 which is charged by the uniform electric potential to form an electrostatic latent image thereon.

The transferring roller 120 may be disposed to face the photosensitive medium 2 to form a transferring nip. A transferring bias may be applied to the transferring roller 120 to transfer a developer image formed on the surface of the photosensitive medium 2 onto the printing medium P. However, the present general inventive concept is not limited thereto. That is, in alternative exemplary embodiments, a corona transferring apparatus (not illustrated) may be used instead of the transferring roller 120.

The developer image transferred onto the surface of the printing medium P by the transferring roller 120 may be attached on the surface of the printing medium P by an electrostatic attraction. The fusing unit 130 may apply heat and/or pressure to fix the developer image on the printing medium P, to thereby form a permanent printed image on the printing medium P.

Hereinafter, a process in which the image forming apparatus 100 having the structure as described above performs a printing operation will now be explained.

When the charging bias is applied to the charging roller 6, the photosensitive medium 2 is charged by a uniform electric potential. The exposure unit 110 may scan light modulated corresponding to the printing data to the photosensitive medium 2 through an opening of the process cartridge 1 to form an electrostatic latent image on the surface of the photosensitive medium 2. The developer stored in the developer storing chamber 8 is supplied and is attached to the surface of the developing roller 5 by the agitator 9 and the supplying roller 7. The regulating member 5*a* forms a developer layer of a uniform thickness on the surface of the developing roller 5. The developing bias is applied to the developing roller 5. The developer is moved to the developing nip D by a rotation of the developing roller 5 so the developer is moved and attached onto the electrostatic latent image, which is formed on the surface of the photosensitive medium 2, by the developing bias. As a result, a visible developer image is formed on the surface of the photosensitive medium 2. The printing medium P is fed from the printing medium feeding unit 150 by a pickup roller 151 and is conveyed to the transferring nip between the transferring roller 120 and the photosensitive medium 2 by a conveying roller 152. When the transferring bias is applied to the transferring roller 120, the developer image is transferred onto the printing medium P by the electrostatic attraction. The developer image transferred onto the printing medium P receives heat and/or pressure from the fusing unit 130, thereby being fused onto the printing medium P. The printing medium P is discharged by the discharging roller 140. The developer that is not transferred onto the printing medium P and remains on the surface of the photosensitive medium 2 is removed by the cleaning member 10.

When the image forming apparatus 100 performs a printing operation using the process cartridge 1, the photosensitive medium 2 rotates on the center shaft 3. At this time, the center shaft 3 is supported by the center moving member 20 and the lever 27 of the center moving member 20 is prevented from moving by the separation restraining protrusion 44 so that the photosensitive medium 2 is not separated from the developing roller 5 during the printing operation. Therefore, the process cartridge 1 according to an exemplary embodiment of the present general inventive concept can prevent or substantially reduce a phenomenon in which horizontal white lines appear in a printed image due to a separation between a photosensitive medium 2 and a developing roller 5.

Although a few exemplary embodiments of the present general inventive concept have been illustrated and described, it will be appreciated by those of ordinary skilled in the art that changes may be made in these exemplary embodiments without departing from the principles and spirit of the general inventive concept, the scope of which is defined in the appended claims and their equivalents

What is claimed is:

1. A process cartridge usable with an image forming apparatus comprising:

a developing member;

a photosensitive medium to face the developing member;

a pair of supporting plates to rotatably support the developing member and the photosensitive medium;

a center moving member rotatably disposed on the supporting plates, the center moving member having a first position in which the photosensitive medium contacts the developing member and a second position in which the photosensitive medium is spaced apart from the developing member; and a separation restraining member formed so that when the center moving member locates at the second position, the separation restraining member restrains the center moving member from moving from the second position, wherein the separation restraining member comprises:

a rotation limiting portion disposed on the supporting plate to limit a rotation range of the center moving member; and a restraining protrusion formed on the supporting plate to restrain the center moving member from moving between the first position and the second position.

2. The process cartridge of claim 1, wherein the rotation limiting portion comprises a guiding groove formed on the supporting plate to guide a rotation of the center moving member; and the center moving member comprises:

an outer circumferential portion that is rotatably disposed in a supporting hole of the supporting plate and is formed in a cylindrical shape;

an inner circumferential portion formed inside the outer circumferential portion, a center of the inner circumferential portion being eccentric to a center of the outer circumferential portion, the inner circumferential portion in which a center shaft of the photosensitive medium is connected;

a lever extending outwardly from the outer circumferential portion; and a guiding projection formed on the lever to insert in and to move along the guiding groove.

3. The process cartridge of claim 2, wherein a first end of the guiding groove corresponds to the first position of the center moving member, and a second end of the guiding groove corresponds to the second position of the center moving member.

4. The process cartridge of claim 2, wherein the restraining protrusion comprises a contact restraining protrusion to restrain the lever of the center moving member from moving from the second position to the first position.

5. The process cartridge of claim 4, wherein the contact restraining protrusion is formed inside the guiding groove to interfere with the guiding projection of the lever of the center moving member.

6. The process cartridge of claim 2, wherein the restraining protrusion comprises a separation restraining protrusion to restrain the center moving member from moving from the first position when the center moving member locates at the first position.

7. The process cartridge of claim 6, wherein the separation restraining protrusion is formed on the supporting plate outside the guiding groove to interfere with a side surface of the lever of the center moving member.

8. The process cartridge of claim 7, wherein the separation restraining protrusion is formed in a triangle section, a first surface of the separation restraining protrusion to face the first end of the guiding groove is formed substantially vertically to prevent the lever from moving toward the second end of the guiding groove, and a second surface of the separation restraining protrusion to face the second end of the guiding groove is formed as an inclined surface so that the lever can move toward the first end of the guiding groove.

9. The process cartridge of claim 2, wherein the center moving member comprises an escape preventing protrusion that is formed on an end portion of the outer circumferential portion near inner surface of the supporting plate and prevents the center moving member from falling out of the supporting hole of the supporting plate.

10. The process cartridge of claim 9, wherein the escape preventing protrusion comprises two escape preventing protrusions formed at an angular interval of 180 degrees and two inserting grooves into which the two escape preventing protrusions are inserted are formed on the supporting hole.

11. The process cartridge of claim 10, wherein the escape preventing protrusions and the inserting grooves have a position relationship in that when the center moving member locates beyond the guiding groove, the escape preventing protrusions are inserted into the inserting grooves so that the center moving member connects with the supporting plate.

12. The process cartridge of claim 9, wherein the supporting plate comprises:

a guiding seat formed on the inner surface of the supporting plate at the outer circumference of the supporting hole to guide a movement of the escape preventing protrusion; and a stopper formed at the guiding seat to limit a rotation of the escape preventing protrusion so that the center moving member moves between the first position and the second position.

13. The process cartridge of claim 2, wherein the center moving member comprises an insert limiting protrusion that is formed on an end portion of the outer circumferential portion near an outer surface of the supporting plate and limits a depth of the center moving member inserted into the supporting hole of the supporting plate.

14. A process cartridge usable with an image forming apparatus, comprising:

a developing member;

a photosensitive medium to face the developing member;

a pair of supporting plates to rotatably support the developing member and the photosensitive medium;

a center moving member rotatably disposed on the supporting plate, the center moving member causing the photosensitive medium to locate either at a first position in which the photosensitive medium contacts the developing member or at a second position in which the photosensitive medium is spaced apart from the developing member; and a separation restraining member formed so that when the center moving member locates at the second position, the separation restraining member restrains the center moving member from escaping from the second position, wherein the separation restraining member comprises:

a guiding groove formed on the supporting plate to guide a rotation of the center moving member and to limit a rotation range of the center moving member; and a contact restraining protrusion formed on the supporting plate to restrain the center moving member from moving from the second position to the first position, and wherein when the process cartridge is separated from the image forming apparatus, the center moving member is moved over the separation restraining member and to the first position by a position changing member of the image forming apparatus.

15. The process cartridge of claim 14, wherein the center moving member comprises:

an outer circumferential portion that is rotatably disposed in a supporting hole of the supporting plate and is formed in a cylindrical shape;

an inner circumferential portion formed inside the outer circumferential portion, a center of the inner circumferential portion being eccentric to a center of the outer circumferential portion, the inner circumferential portion in which a center shaft of the photosensitive medium is connected;

a lever to extend from the outer circumferential portion; and a guiding projection formed on the lever to insert in and to move along the guiding groove.

16. The process cartridge of claim 15, wherein the contact restraining protrusion is formed inside the guiding groove to interfere with the guiding projection of the lever of the center moving member.

17. The process cartridge of claim 15, wherein the center moving member comprises an insert limiting protrusion that is formed on an end portion of the outer circumferential portion near an outer surface of the supporting plate and limits a depth of the center moving member inserted into the supporting hole of the supporting plate.

18. The process cartridge of claim 14, wherein a first end of the guiding groove corresponds to the first position of the center moving member, and a second end of the guiding groove corresponds to the second position of the center moving member.

19. The process cartridge of claim 14, wherein the separation restraining member further comprises:

a separation restraining protrusion formed on the supporting plate to prevent the center moving member from moving from the first position to the second position when the center moving member locates at the first position.

20. The process cartridge of claim 14, wherein the center moving member comprises an escape preventing protrusion that is formed on an end portion of the outer circumferential portion near an inner surface of the supporting plate and prevents the center moving member from falling out of the supporting hole of the supporting plate.

21. The process cartridge of claim 20, wherein the escape preventing protrusion comprises two escape preventing protrusions formed at an angular interval of 180 degrees and two inserting grooves into which the two escape preventing protrusions are inserted are formed on the supporting hole.

22. The process cartridge of claim 21, wherein the escape preventing protrusions of the center moving member and the inserting grooves of the supporting hole have a position relationship in that when the lever of the center moving member locates beyond the guiding groove, the escape preventing protrusions are inserted into the inserting grooves so that the center moving member connects with the supporting plate.

23. A process cartridge usable with an image forming apparatus, comprising:

a developing member;

a photosensitive medium to face the developing member;

a pair of supporting plates to rotatably support the developing member and the photosensitive medium;

a center moving member rotatably disposed on the supporting plate, the center moving member causing the photosensitive medium to locate either at a first position in which the photosensitive medium contacts the developing member or at a second position in which the photosensitive medium is spaced apart from the developing member; and a separation restraining member formed so that when the center moving member locates at the second position, the separation restraining member restrains the center moving member from moving from the second position, wherein the separation restraining member comprises:

a guiding groove formed on the supporting plate to guide a rotation of the center moving member and to limit a rotation range of the center moving member; and a contact restraining protrusion formed on the supporting plate to restrain the center moving member from moving from the second position to the first position, and wherein when the process cartridge is installed along a guide rail of the image forming apparatus, the center moving member moves over the separation restraining member and to the first position.

24. An image forming apparatus, comprising:

a main body;

a process cartridge removably disposed in the main body, the process cartridge comprising:

a developing member;

a photosensitive medium to face the developing member;

a pair of supporting plates to rotatably support the developing member and the photosensitive medium;

a center moving member rotatably disposed on the supporting plate, the center moving member having a first position in which the photosensitive medium contacts the developing member and a second position in which the photosensitive medium is spaced apart from the developing member; and a separation restraining member formed so that when the center moving member locates at the second position, the separation restraining member restrains the center moving member from moving from the second position; and a position changing member disposed in the main body so that when the process cartridge is separated from the main body, the position changing member causes the center moving member at the second position to move over the separation restraining member to the first position, wherein the separation restraining member comprises:

a rotation limiting portion disposed on the supporting plate to limit a rotation range of the center moving member; and a restraining protrusion formed on the supporting plate to restrain the center moving member from moving between the first position and the second position.

25. An image forming apparatus, comprising:

a main body;

guide rails formed on opposite side surfaces of the main body; and a process cartridge removably disposed along the guide rails, wherein the process cartridge comprises:

a developing member;

a photosensitive medium to face the developing member;

a pair of supporting plates to rotatably support the developing member and the photosensitive medium;

a center moving member rotatably disposed on the supporting plate, the center moving member having a first position in which the photosensitive medium contacts the developing member and a second position in which the photosensitive medium is spaced apart from the developing member;

a separation restraining member formed so that when the center moving member locates at the second position, the separation restraining member restrains the center moving member from escaping from the second position; and wherein the separation restraining member comprises:

a rotation limiting portion disposed on the supporting plate to limit a rotation range of the center moving member; and a restraining protrusion formed on the supporting plate to restrain the center moving member from moving between the first position and the second position, and wherein when the process cartridge is installed into the main body along the guide rails, the center moving member moves from the second position to the first position over the separation restraining member.

26. A developer having a developing member and a photosensitive medium usable with an image forming apparatus, the developer comprising:

a center moving member including an escape preventing protrusion and an insert limiting protrusion formed on an outer circumferential portion thereof, the center moving member being movable between a first position in which the photosensitive medium is spaced apart from the developing member and a second position in which the photosensitive medium contacts the developing member, wherein the center moving member moves from the first position to the second position to form a developing nip when installed within the image forming apparatus.

27. The developer of claim 26, further comprising a separation restraining member to restrain the center moving member from moving from the second position after being installed within the image forming apparatus.

* * * * *